US008293038B2

(12) United States Patent
Takahashi et al.

(10) Patent No.: US 8,293,038 B2
(45) Date of Patent: Oct. 23, 2012

(54) FERRITIC STAINLESS STEEL CASTING AND SHEET AND METHOD FOR PRODUCING THE SAME

(75) Inventors: Akihiko Takahashi, Hikari (JP); Junichi Hamada, Hikari (JP); Ken Kimura, Futtsu (JP); Takashi Morohoshi, Kitakyushu (JP); Yoshihito Yamada, Hirkari (JP); Toyohiko Kakihara, Tokyo (JP); Satoshi Hashimoto, Hikari (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 985 days.

(21) Appl. No.: 11/985,296

(22) Filed: Nov. 13, 2007

(65) Prior Publication Data

US 2008/0142123 A1 Jun. 19, 2008

Related U.S. Application Data

(62) Division of application No. 10/478,759, filed as application No. PCT/US03/03892 on Mar. 27, 2003, now abandoned.

(30) Foreign Application Priority Data

Mar. 27, 2002 (JP) ..... 2002-087703
Mar. 27, 2002 (JP) ..... 2002-087704
Apr. 17, 2002 (JP) ..... 2002-114998

(51) Int. Cl.
*C22C 38/00* (2006.01)

(52) U.S. Cl. ..... 148/605; 148/609; 148/610

(58) Field of Classification Search ..... 148/605, 148/609, 610

See application file for complete search history.

(56) References Cited

FOREIGN PATENT DOCUMENTS

| | | |
|---|---|---|
| EP | 1 099 498 | 5/2001 |
| EP | 1099498 A1 | 5/2001 |
| JP | A-58-061258 | 4/1983 |
| JP | A-59-083725 | 5/1984 |
| JP | A-61-023720 | 2/1986 |
| JP | A-62-77423 | 4/1987 |
| JP | A-01-075652 | 3/1989 |
| JP | A-04-341521 | 11/1992 |
| JP | A-7-268485 | 10/1995 |
| JP | 8-225852 A | 9/1996 |
| JP | A-10-324956 | 12/1998 |
| JP | 11-100617 | 4/1999 |

(Continued)

OTHER PUBLICATIONS

Takeuchi et al., Tetsuo-to-Hagene, vol. 66, No. 6, pp. 638-646, May 1980.

(Continued)

*Primary Examiner* — Sikyin Ip
(74) *Attorney, Agent, or Firm* — Kenyon & Kenyon LLP

(57) ABSTRACT

The present invention provides a ferritic stainless steel casting and a sheet thereof excellent in deep drawability, punch stretchability and ridging resistance and a method for producing the casting and the sheet. In the present invention, a chemical composition is controlled so that the amounts of C, N, Si, Mn, P and Ti may be reduced to the utmost for securing high workability and, on the basis of the chemical composition, the roping and ridging of a steel sheet product is reduced by adding Mg, thus dispersing Mg containing oxides that accelerate the formation of nuclei for solidification and, resultantly, suppressing the development of coarse columnar crystals in a casting. The present invention is characterized in that the average composition of the Mg containing oxides dispersing in a casting satisfies the following expressions <2> and <3>, $$17.4(Al_2O_3)+3.9(MgO)+0.3(MgAl_2O_4)+18.7(CaO)\leqq 500 \quad <2>,$$

$$(Al_2O_3)+(MgO)+(MgAl_2O_4)+(CaO)\geqq 95 \quad <3>.$$

6 Claims, 8 Drawing Sheets

FOREIGN PATENT DOCUMENTS

| | | | |
|---|---|---|---|
| JP | A-11-350090 | | 12/1999 |
| JP | 2000073123 | * | 3/2000 |
| JP | A-2000-144342 | | 5/2000 |
| JP | 2000-178696 A | | 6/2000 |
| JP | 2000 192200 | | 7/2000 |
| JP | 2000-192200 | | 7/2000 |
| JP | A-2000-192199 | | 7/2000 |
| JP | 2000-212704 A | | 8/2000 |
| JP | 2000-297355 | | 10/2000 |
| JP | 2000-328173 A | | 11/2000 |
| JP | 2001-011582 | | 1/2001 |
| JP | 2001-192782 A | | 7/2001 |
| JP | 2001-269747 A | | 10/2001 |
| JP | 2001-294990 A | | 10/2001 |

OTHER PUBLICATIONS

European Search Report dated May 19, 2011 issued in corresponding EP Application No. EP 11 15 5641.

* cited by examiner

FERRITIC STAINLESS STEEL CASTING AND SHEET AND METHOD FOR PRODUCING THE SAME

This application is a divisional application under 35 U.S.C. §120 and §121 of prior application Ser. No. 10/478,759, filed Nov. 25, 2003, now abandoned, which is a 35 U.S.C. §371 of International Application No. PCT/JP2003/03892, filed Mar. 27, 2003, wherein PCT/JP2003/03892 was filed and published in the Japanese language.

TECHNICAL FIELD

The present invention relates to a ferritic stainless steel casting and a ferritic stainless steel sheet excellent in workability and a method for producing the casting and the sheet and, more specifically, to a casting and a sheet and the production method thereof for producing a ferritic stainless steel sheet that is excellent in elongation and a Lankford value (hereunder referred to as an "r-value"), these being the indices of workability, and, at the same time, hardly suffers defects such as ridging and roping.

BACKGROUND ART

A ferritic stainless steel sheet is widely used for applications such as home electric appliances, kitchen instruments, electronic apparatuses and the like. However, a ferritic stainless steel sheet is inferior to an austenitic stainless steel sheet in workability and therefore the applications of a ferritic stainless steel sheet are sometimes limited.

During the course of attempting to solve the above problem, refining technologies have improved recently and therefore it has been possible to reduce carbon and nitrogen to ultra-low levels and, further, by adding stabilizing elements such as Ti and Nb, to improve formability.

The conventional technologies for improving the formability of a ferritic stainless steel sheet are mostly ones for improving deep drawability, namely an r-value. With regard to hot rolling conditions for example, the technologies for improving an r-value by regulating a hot-rolling temperature and so on are disclosed in Japanese Unexamined Patent Publications No. S62-77423 and No. H7-268485. However, the real situation is that, even using such technologies, satisfactory properties are sometimes not secured when the amounts of steel components fluctuate. Further, with regard to cold rolling conditions, the technologies for improving an r-value by applying rolling with large diameter rolls are disclosed, for example, in Japanese Unexamined patent Publications No. S59-083725, No. S61-023720 and No. 2000-178696. Moreover, there have been the cases where satisfactory properties are not secured depending on the steel components, intermediate annealing or final annealing conditions.

Furthermore, in actual working, only deep drawing formability is not enough and punch stretchability is often required. A ferritic stainless steel has the drawback of very poor punch stretchability because it is inferior to an austenitic stainless steel in elongation. However, studies on the drawback have scarcely been done. An improvement in elongation is effective for the improvement of punch stretchability and the technologies related to components for improving punch stretchability are disclosed, for example, in Japanese Unexamined Patent Publication No. S58-061258, No. H01-075652 and No. H11-350090. However, the real situation is that, by technologies which merely adjust steel components, satisfactory elongation, namely satisfactory punch stretch formability, is not secured.

Still further, a problem of a ferritic stainless steel sheet is that linear jogs called ridging appear on the surface thereof after the steel sheet is subjected to press working and, when the ridging is excessive, cracks occur during working. A technology for improving ridging by adjusting hot rolling conditions is disclosed, for example, in Japanese Unexamined Patent Publication No. H04-341521. However, the basic concept of the technology is to accelerate recrystallization by applying large reduction rolling at rough rolling and the drawbacks in this case are that significant defects appear on a hot-rolled steel sheet and also that excessive ridging appears in the event of severe working. In addition, as technologies for improving ridging by fractionizing a solidification structure, the technologies wherein Mg oxide particles are controlled by adding Mg are disclosed in Japanese Unexamined Patent Publication No. H10-324956 and No. 2000-192199. However, the drawback in such disclosed technologies is that ridging occurs unevenly and even excessively in the event of severe working.

Meanwhile, a so-called high-purity ferritic stainless steel wherein the amounts of C and N are lowered and Ti is added as a stabilizing element has a lower possibility of generating stress corrosion cracking than SUS 304, that represents an austenitic stainless steel, and further, it has the advantage of lowering costs because it does not contain Ni. However, a drawback of a high-purity ferritic stainless steel is that the elongation, that is important as an index of workability, is lower than that of SUS 304. Further, for improving the workability of a high-purity ferritic stainless steel, it is necessary to lower the amounts of C and N, as interstitial solid solution elements, and also the amounts of Si, Mn, P, Ti, etc., as substitutional solid solution elements.

When a higher purification of a ferritic stainless steel is further attempted, such a high-purity ferritic stainless steel is liable to develop a coarse columnar crystal structure in the structure of a casting that is the raw material of a steel sheet and to cause roping of a cold-rolled steel sheet and ridging, at the working of a cold-rolled and annealed product, to occur conspicuously. In an attempt to reduce roping and ridging, methods wherein a casting structure is made to be composed of equiaxed crystals and thus the structure is fractionized are proposed. A typical method is to add Ti (about 0.2 to 0.3 mass % for example), precipitate TiN in molten steel before the molten steel solidifies, and then accelerate the formation of nuclei for solidification by using TiN as the nuclei of heterogeneous nucleation (Hidemaro Takeuchi et al, Tetsu To Hagane, 66 (1980) 638). According to this method, when an equiaxed crystal ratio is controlled to about 60 to 70% or more, ridging is effectively reduced. In this method, however, since Ti is added by about 0.2 to 0.3%, Ti exceeding the amount required for the formation of TiN dissolves unavoidably in steel and, resultantly, the elongation of a steel sheet deteriorates. Therefore, the method is not compatible with the intention of improving the workability of a steel sheet.

A method wherein, even with a smaller addition amount of Ti, equiaxed crystallization is accelerated by complexly precipitating TiN in Al—Ti type inclusions has been disclosed (Japanese Unexamined Patent Publication No. 2000-144342). The method makes it possible to prevent the deterioration of the elongation of a steel sheet caused by an excessive amount of Ti. However, Si must be contained for precipitating TiN by this method as explained later. It is well known that Si deteriorates the elongation of a steel sheet even though the addition amount is small. Therefore, in this method too, to make a casting structure composed of equiaxed crystals and fractionized in order to recure ropind and ridging is not compatible with enhancing elongation.

The object of the present invention is, by solving the problems of prior art, to provide a method for producing a ferritic stainless steel sheet excellent in deep drawability, punch stretchability and ridging resistance.

In aforementioned conventional technologies in particular, Ti and Si, that deteriorate the elongation of a steel sheet, must be used inevitably for fractionizing a casting structure and thus reducing roping and ridging. Therefore, the technologies are not compatible with the expectations of highly purifying a steel sheet and thus securing such workability that allows SUS 304 to be replaced with the steel sheet. In view of the above situation, the object of the present invention is to make it possible to secure both a high workability of a steel sheet and the enhancement of roping and ridging resistance simultaneously by reducing to the utmost the amounts of Ti and Si that cause the elongation of the steel sheet to deteriorate and thus attaining the substantial fractionization of a casting structure even when a high purity is maintained.

DISCLOSURE OF THE INVENTION

For solving aforementioned problems, the present inventors carried out detailed studies on steel compositions, the behavior of oxides in molten steel and in a solidification structure, the behavior of precipitation and recrystallization during annealing, and the formation of the structure during cold rolling and annealing in an attempt to improve the workability of a ferritic stainless steel sheet.

The present invention makes it possible to solve aforementioned problems advantageously and, in the present invention, a chemical composition is controlled so that the amounts of C, N, Si, Mn, P and Ti may be reduced to the utmost for securing a high workability and, on the basis of the chemical composition, the roping and ridging of a product is reduced by adding Mg, thus dispersing oxides containing Mg that accelerate the formation of nuclei for solidification, and resultantly suppressing the development of coarse columnar crystals in a casting. The gist of the present invention is as follows.

(1) A ferritic stainless steel casting characterized in that: said casting contains, in mass, 0.001 to 0.010% C, 0.01 to 0.30% Si, 0.01 to 0.30% Mn, 0.01 to 0.04% P, 0.0010 to 0.0100% S, 10 to 20% Cr, 0.001 to 0.020% N, 0.05 to 0.30% Ti, and 0.0002 to 0.0050% Mg, with the balance consisting of Fe and unavoidable impurities, and the value of Σ defined by the expression is 0.70 or less, $$\Sigma=0.9[Si]+8.6[P]+2[Ti]+0.5[Mn]-0.5 \quad <1>;$$

and the average composition of the Mg containing oxides dispersing in said casting satisfies the expressions <2> and <3>, $$17.4(Al_2O_3)+3.9(MgO)+0.3(MgAl_2O_4)+18.7(CaO)\leqq 500 \quad <2>,$$

$$(Al_2O_3)+(MgO)+(MgAl_2O_4)+(CaO)>95 \quad <3>,$$

where the chemical components in the parentheses mean mol % of the relevant chemical components, respectively.

(2) A ferritic stainless steel casting according to the item (1), characterized in that said casting further contains, in mass, 0.0003 to 0.0050% B and/or 0.005 to 0.1% Al.

(3) A ferritic stainless steel casting according to the item (1) or (2), characterized in that said casting further contains, in mass, one or more of 0.1 to 2.0% Mo, 0.1 to 2.0% Ni, and 0.1 to 2.0% Cu.

(4) A ferritic stainless steel casting according to any one of the items (1) to (3), characterized in that said casting further contains, in mass, one or more of 0.01 to 0.5% Nb, 0.1 to 3.0% V, and 0.01 to 0.5% Zr.

(5) A ferritic stainless steel casting according to any one of the items (1) to (4), characterized in that the average width of the columnar crystals is 4 mm or less at a portion in the depth of one fourth of the thickness of said casting.

(6) A ferritic stainless steel sheet characterized by being produced from a casting according to any one of the items (1) to (5).

(7) A method for producing a ferritic stainless steel sheet, characterized by using a casting according to any one of the items (1) to (5).

(8) A method for producing a ferritic stainless steel sheet according to the item (7), characterized by charging MgO and/or metallic Mg in molten steel at not less than 0.30 kg per molten steel ton in terms of Mg equivalent.

(9) A method for producing a ferritic stainless steel sheet according to the item (7) or (8), characterized in that: when a casting is hot rolled, the reheating temperature T1 of said casting is controlled to within the range defined by the expression <4>, said heated casting is subjected to rough rolling of plural passes, thereafter finish rolling of plural passes is finished at a temperature of 850° C. or lower, and subsequently said hot-rolled steel sheet is coiled at a temperature of 700° C. or lower; and thereafter said hot-rolled steel sheet is annealed at a heating temperature T2 in the range defined by the expression <5> and cold rolled, and subsequently said cold-rolled steel sheet is annealed at a heating temperature T3 in the range defined by the expression <6>, $$1{,}000\leqq T1(^\circ C.)\leqq -100-8{,}714/(\log([Ti]\times[C]^{0.5}\times[S]^{0.5})-3.4) \quad <4>,$$

$$-5{,}457/(\log([T1]\times[C])-2.6)\leqq T2(^\circ C.)\leqq 1{,}000 \quad <5>,$$

$$-100-5{,}457/(\log([Ti]\times[C])-2.6)\leqq T3(^\circ C.)\leqq -5{,}457/(\log([Ti]\times[C])-2.6) \quad <6>.$$

(10) A method for producing a ferritic stainless steel sheet according to the item (7) or (8), characterized in that: a casting is hot rolled; thereafter said hot-rolled steel sheet, without subjected to hot band annealing, is cold rolled at a reduction ratio of 30% or more in a rolling mill equipped with rolls 300 mm or larger in diameter; and thereafter said cold-rolled steel sheet is subjected to intermediate annealing at a heating temperature T4 in the range defined by the expression <7>, cold rolled again to a prescribed thickness, and thereafter subjected to final annealing at a heating temperature T5 in the range defined by the expression <8>, $$700\leqq T4(^\circ C.)\leqq -50-5{,}457/(\log([Ti]\times[C])-2.6) \quad <7>,$$

$$-100-5{,}457/(\log([Ti]\times[C])-2.6)\leqq T5(^\circ C.)\leqq 5{,}457/(\log([Ti]\times[C])-2.6) \quad <8>.$$

BEST MODE FOR CARRYING OUT THE INVENTION

Figure 1:
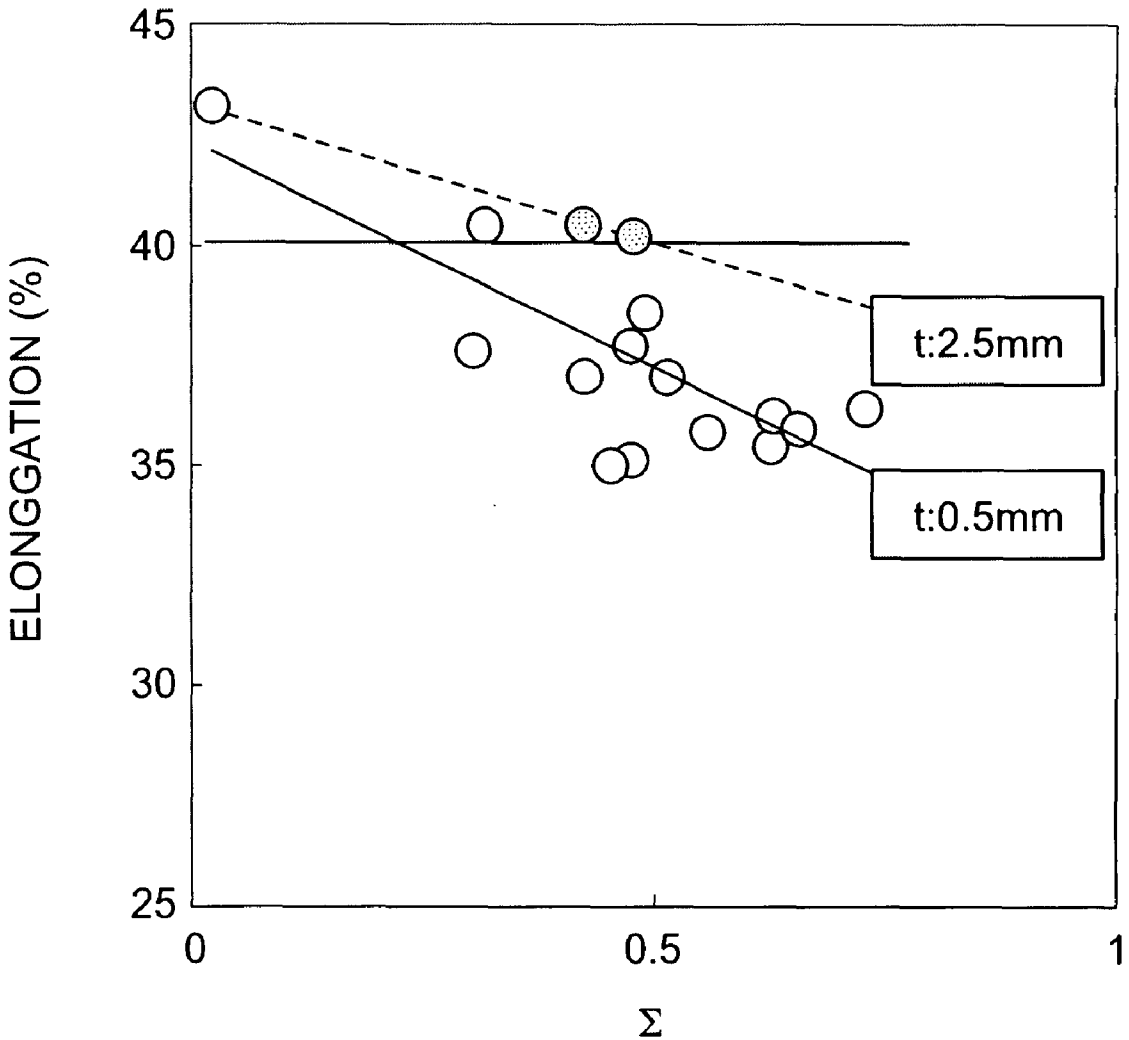
FIG. 1 is a graph showing the relationship between the elongations and the high-purification indexes E of steel sheets.

The present inventors aimed to develop a high-purity ferritic stainless steel having such a high workability that allows SUS 304 to be partly replaced with the steel on the premise that, firstly, the amounts of carbon and nitrogen in the steel were reduced up to ultra-low levels by employing vacuum refining. On that premise, the steel was highly purified to the utmost by reducing also the amounts of Si, Mn, P and Ti to the utmost in a refining process and, by so doing, the elongation of the steel, that was a shortcoming of a ferritic stainless steel in comparison with SUS 304, was improved. Steels were produced by using Fe-17% Cr alloy as the base material and melting the alloy in a laboratory while the contents of C, N, si, Mn, P and Ti were varied. Then, the elongations in the rolling direction (the test pieces for the elongation measurement were prepared in conformity with JIS No. 13B) of the steel sheets produced through the processes of hot rolling, cold rolling and annealing were measured and the relationship between the elongations and the amounts of C, N, Si, Mn, P and Ti was obtained by regression analysis. As shown in FIG. 1, there is a high correlation between elongation and E defined by the expression <1> and, in the case of the steel sheets 0.5 mm in thickness (shown in FIG. 1 by the marks ○ and the solid line), a high elongation of 35% or more is obtained when the value of Σ is 0.70 or less. Further, it is confirmed that, in the case of the steel sheets 2.5 mm in thickness (shown in FIG. 1 by the marks ● and the broken line), a very high elongation of 40% or more for a ferritic stainless steel sheet is obtained when the value of Σ is controlled to 0.50 or less. That is, the figure shows that the lower the value of Σ is (namely, the higher the purity is), the higher the elongation is. Here, in the case of FIG. 1, the components are adjusted so as to satisfy the expression Ti=15(C+N) and thus the influences of C and N are included in the term of Ti in the expression <1>, $$\Sigma=0.9[Si]+8.6[P]+2[Ti]+0.5[Mn]-0.5 \quad <1>.$$

Figure 2:
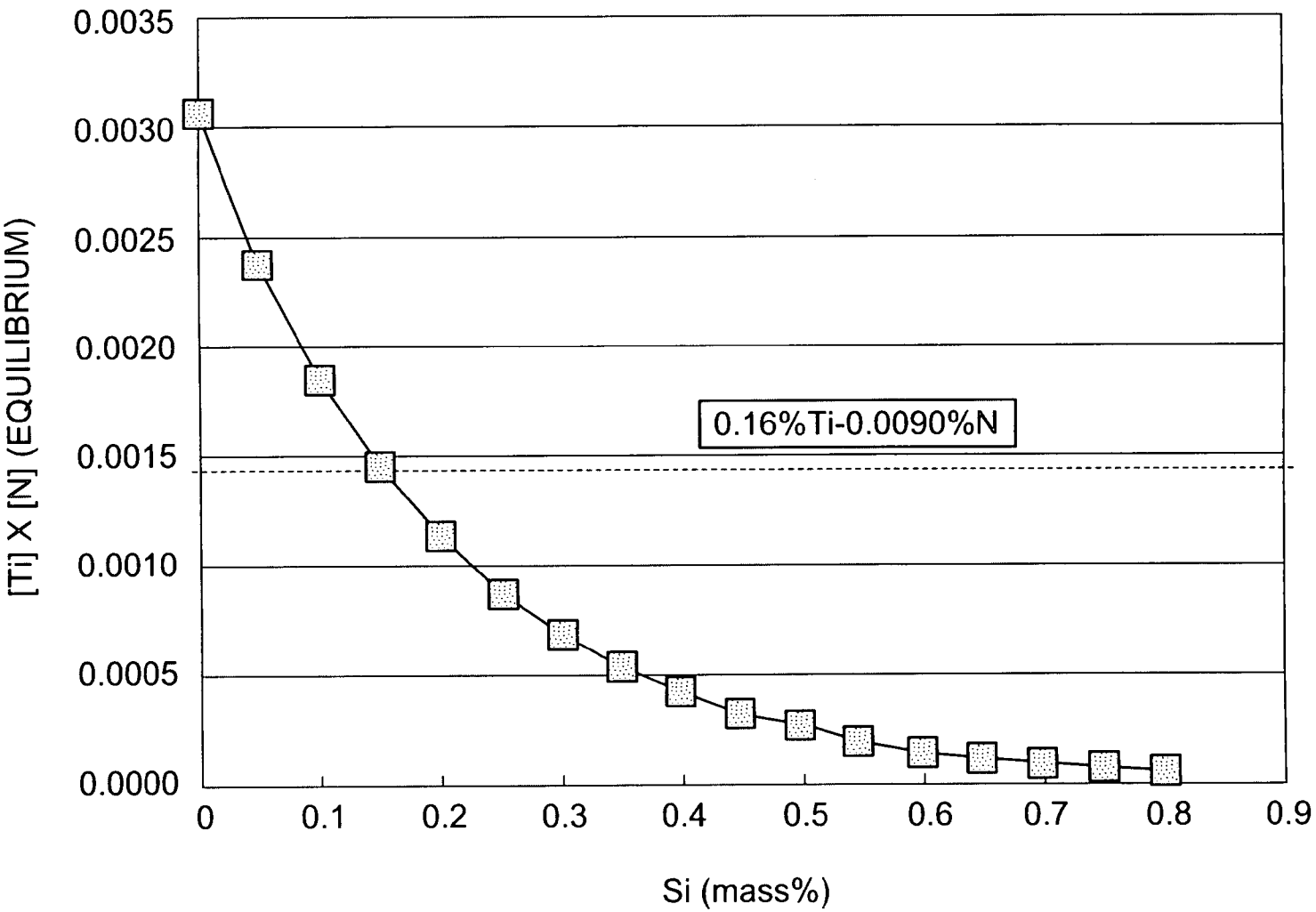
FIG. 2 is a graph showing the influence of Si in molten steel on the equilibrium solubility products of TiN.

In such a highly purified steel, the casting structure thereof is composed of coarse columnar crystals and the fractionization of the columnar crystals is required for reducing the roping and ridging of the steel product. However, the present inventors clarified the fact that, in a steel composition according to the present invention, it was difficult to make use of TiN complexly precipitating in Al—Ti inclusions as solidification nuclei for the fractionization in spite that said TiN was used for that purpose in prior art. The present inventors, with regard to an Fe based alloy containing 16.5% Cr, 0.16% Ti and 0.0090% N, evaluated the influence of components in the alloy on the equilibrium solubility product of TiN, namely the threshold value of a solubility product [% Ti]×[% N] beyond which TiN precipitated in molten steel, at a temperature of 1,500° C. and found that the influence of Si was significant. FIG. 2 shows the influence of Si on the equilibrium solubility product of TiN. It is understood that the equilibrium solubility product increases abruptly as the amount of Si decreases and that precipitation of TiN becomes difficult. In the case of a steel containing 16.5% Cr, 0.16% Ti and 0.0090% N, TiN does not precipitate unless an equilibrium solubility product is in the region equal to or below the broken line shown in FIG. 2. In the case of a steel containing Si in the range of not more than 0.20% intended in the present invention, when an Si content is in the range from 0.15 to 0.20%, though TiN precipitates, the precipitated amount is small and, when an Si content is in the range of 0.15% or less, TiN does not precipitate at all in molten steel. For that reason, in the case of a low Si steel according to the present invention, it is difficult to make TiN precipitate in molten steel and function as solidification nuclei and to make equiaxed crystals form.

In view of the above situation, the present inventors investigated oxides that could act as effective solidification nuclei in a low Si steel according to the present invention wherein the function of TiN as solidification nuclei was not expected. As a result, the present inventors found: that solidification was accelerated by adding Mg in molten steel and dispersing oxides containing Mg in the molten steel; and further that the composition of oxides forming as a result of deoxidization significantly influenced the suppression of the development of coarse columnar crystals and, when the average composition of the oxides containing Mg dispersing in the steel satisfied the following expressions <2> and <3>, the columnar crystals were fractionized, $$17.4(Al_2O_3)+3.9(MgO)+0.3(MgAl_2O_4)+18.7(CaO)\leqq 500 \quad <2>,$$

$$(Al_2O_3)+(MgO)+(MgAl_2O_4)+(CaO)\geqq 95 \quad <3>,$$

where the chemical components in the parentheses meant mol % of the relevant chemical components, respectively. The present invention was established on the basis of the above findings.

The composition of an oxide containing Mg is analyzed by the following procedures. A test piece for an EPMA (an electron probe microanalyzer) or a scanning electron microscope (an SEM) is cut out from a casting and the surface of the test piece is polished specularly with diamond or the like. An inclusion about 1 μm in size is detected by an EPMA or an SEM and the composition of the inclusion is analyzed by wavelength dispersive analysis (ZAF analysis) in the case of the EPMA or by energy dispersive analysis (EDX analysis) in the case of the SEM. The present inventors used the following analyzers; EPMA: JXA8800R and JXA8800RL made by JEOL Ltd., SEM: JSM-820 made by JEOL Ltd., and EDX attached to SEM: OXFORD MODEL 6779. Though inclusions of not more than 1 μm in size are also observed in the test piece, the analytical accuracy thereof is inferior. An inclusion not less than 1 μm in size is estimated to function as solidification nucleus more effectively and therefore an inclusion not less than 1 μm in size is selected as the object of the analysis. In many cases, observed inclusions show the shapes formed by complexly precipitating sulfide and nitride in oxide during the course of cooling after solidification. The analyzable main elements constituting oxide are Mg, Al, Ca, Ti and Si and Ti constitutes any of oxide, nitride and sulfide. Then, the mol % of each of the four kinds of oxides included in the expressions <2> and <3> is calculated by using the analysis results of Mg, Al, Ca and Si and regarding the oxides as the ones consisting of MgO, $Al_2O_3$, $MgAl_2O_4$, CaO and the oxides not containing Mg, Al and Ca ($SiO_2$, for example). Here, among the inclusions observed on the surface of the test piece, the inclusions not containing Mg are excluded from the calculation. The exclusion may be done simply by excluding the inclusions wherein the contents of Mg detected in the energy dispersive analysis are less than 1 mass % from the calculation. At least 20 pieces or more of oxides containing Mg are analyzed, the average mol % thereof is calculated, and then the values of the left sides of the expressions <2> and <3> are calculated.

The reason why columnar crystals are fractionized when the average composition of the oxides containing Mg dispersing in steel satisfies the expressions <2> and <3> is estimated to be as follows. Firstly, by adjusting the average composition of the oxides containing Mg so as to satisfy the expression <3>, the oxides containing Mg are composed of MgO—$Al_2O_3$—CaO type oxides wherein the contents of the components, such as $SiO_2$ and FeO, that hinder the function of the Mg containing oxides as solidification nuclei of ferrite are small. Secondly, in addition to the above, when the average composition of the Mg containing oxides satisfies the expression <2>, the oxides exist in the state of a solid phase at a temperature of not lower than the liquidus temperature of the molten steel, also the lattice unmatching between the oxides and primary crystals (ferrite) is low, thus the increase of surface energy accompanying solidification is also low and, therefore, the oxides function favorably as solidification nuclei.

The fractionization of a casting structure in the present invention does not necessarily require the increase of an equiaxed crystal ratio. As far as Mg containing oxides the composition of which satisfies the expressions <2> and <3> disperse and the development of coarse columnar crystals is suppressed, the roping and ridging of a steel product can be reduced even though an equiaxed crystal ratio is low (for example, 10 or 15%). As a criterion of the fractionization of columnar crystals, it is acceptable if the average width of columnar crystals is 4 mm or less at a portion in the depth of one fourth of the thickness of a casting. Here, the average width of columnar crystals is defined by the value obtained by taking a macroscopic photograph of a transverse section of a casting (a section perpendicular to the casting direction) and dividing the length of a segment drawn at the depth of one fourth of the thickness by the number of columnar crystals intersected by the segment.

As explained above, the primary feature of the present invention is to prevent the surface defects, such as ridging and roping, caused by a coarse solidification structure from forming on a steel product by adding Mg in the steel.

Mg forms Mg oxides in molten steel, functions as solidification nuclei of a ferrite phase during the course of solidification, and can form the ferrite phase finely at the time of solidification. By fractionizing a solidification structure, the surface defects, such as ridging and roping, caused by a coarse solidification structure can be prevented from forming on a steel product. The active formation of Mg oxides functioning as ferrite solidification nuclei is effectuated when an Mg amount is 0.0002% or more. Further, as Mg oxides function as the crystallization nuclei of TiN in molten steel, the Mg oxides can make TiN crystallize in molten steel even though the contents of Ti and N are low. As TiN also functions as solidification nuclei of a ferrite phase during the course of solidification, by accelerating the crystallization of TiN, it is possible to form a ferrite phase finely at the time of solidification and to prevent surface defects, such as ridging and roping caused by a coarse solidification structure, from forming on a steel product.

With regard to the addition of Mg in steel, not only the addition of metallic Mg but also the addition of MgO effectuates the decrease of surface defects. By charging MgO and/or metallic Mg in molten steel by not less than 0.30 kg per molten steel ton in terms of metallic Mg equivalent, a solidification structure is fractionized and the height of ridging is suppressed to 5 μm or less, a level not recognized visually, even after severe press working.

Metallic Mg has a strong affinity with oxygen and forms MgO. However, it tends to gasify in relation to other elements and therefore the yield thereof is unstable. In view of this fact, an Mg concentration of 0.0002% or more in a steel is secured by charging MgO and/or metallic Mg by 0.30 kg/ton or more in terms of metallic Mg equivalent.

A preferable means for forming Mg—Al type oxides functioning as the solidification nuclei of ferrite in molten steel is to properly deoxidize the molten steel with Al, thereafter add Ti and, on top of that, add Mg. Firstly, by deoxidizing molten steel with Al, $Al_2O_3$ is formed as a deoxidized product in the molten steel. Secondly, by adding Ti, Ti oxides (TiO and $Ti_2O_3$) are formed besides $Al_2O_3$ in the molten steel. In addition to that, by adding Mg, $Al_2O_3$ and Ti oxides that have already been formed are reduced by Mg and MgO and $Al_2O_3$—MgO that are likely to act as the solidification nuclei of ferrite are formed dispersedly. When deoxidization proceeds excessively by first added Al, the formed main oxides are $Al_2O_3$ even after Mg is added and the fractionization of a solidification structure is not attained. Therefore, the deoxidization by Al must be properly controlled. A preferable criterion thereof is that the ratio of Ti to Al in molten steel before Mg addition is 6 or more.

Further, in an actual refining process, it is difficult to stably form the intended Mg oxides by only specifying such a simple order of deoxidization and it is necessary to control the composition of slag existing on molten steel. In an actual refining, slag exists at the upper portion of molten steel and inclusions are removed from the molten steel by using oxidation/reduction reaction occurring between the molten steel and the slag. For example, in the case of desulfurization, desulfurization is facilitated by reducing oxygen in molten steel through deoxidization by Al and adjusting the basicity through the addition of lime (CaO) to slag. In this case, when an addition amount of CaO is abundant, the inclusions in the molten steel become $CaOAl_2O_3$ type ones, so-called calcium aluminate. Calcium aluminate generally has a low melting point and is in such a state that the solution thereof having the composition of inclusions floats at the solidification temperature of a steel. Therefore, calcium aluminate is not expected to function as the solidification nuclei of ferrite. For that reason, when CaO is excessively added in slag, the fractionization of a solidification structure is not secured.

Meanwhile, when CaO is added in slag, inclusions of an MgO—CaO type having a high melting point may sometimes be formed by the addition of Mg. In this case, though solid phase inclusions can be formed in molten steel, MgO—CaO type oxides show poor lattice matching and therefore the function thereof, as solidification nuclei of ferrite, deteriorates. From the above facts, as a criterion for controlling a slag composition, it is preferable that the ratio $(CaO)/(Al_2O_3)$ in slag before the addition of Mg is less than 0.9.

Mg may be added by charging metallic Mg, Mg oxide or alloy containing Mg in molten steel by a method of using a lance at a secondary refining process, the so-called injection method. Otherwise, metallic Mg, Mg oxide or alloy containing Mg may be charged in a tundish or a mold at a continuous casting process. In this case, a wire for charging Mg may be prepared and Mg may be charged continuously in the form of a wire. Still otherwise, Mg may be added in molten steel by utilizing a refining reaction between the molten steel and slag. For example, Mg can be contained in molten steel by adding MgO to slag and utilizing the equilibrium deoxidization reaction between the slag and the molten steel. Likewise, by devising the composition of the refractory lining material of a ladle, Mg can be contained in molten steel by utilizing the reaction between the molten steel and the refractory material.

Next, the reasons for regulating the components in the present invention are explained.

C deteriorates workability and corrosion resistance and, therefore, the smaller the C content, the better. Further, in the case of a Ti added steel, fine TiC sometimes precipitates excessively during hot rolling or recrystallization annealing. In this case, since recrystallization is considerably delayed and an un-recrystallized structure is formed, ridging resistance deteriorates when a steel product is subjected to press working, the development of a texture that improves deep drawability is suppressed, and the growth of crystal grains is also delayed. For those reasons, the upper limit of a C amount is set at 0.010%. On the other hand, an excessive reduction of a C amount leads to the increase of a refining cost and therefore the lower limit of a C amount is set at 0.001%. In consideration of a production cost and corrosion resistance, a preferable range of a C amount is from 0.002 to 0.005%.

Si is sometimes added as a deoxidizing element. However, Si is a solid solution strengthening element and, from the viewpoint of elongation, the smaller the content, the better. Therefore, the upper limit of an Si amount is set at 0.30%. On the other hand, an excessive reduction of an Si amount leads to the increase of a refining cost and therefore the lower limit of an Si amount is set at 0.01%. In consideration of a production cost and corrosion resistance, a desirable upper limit of an Si amount is 0.20%, and a more desirable range thereof is from 0.05 to 0.15%. Further, when an Si amount is not more than 0.15%, since the crystallization of TiN in molten steel and the fractionization of a solidification structure are not expected, the effect of Mg addition according to the present invention appears conspicuously.

Mn, like Si, is a solid solution strengthening element and, therefore, the smaller the amount, the better. From the view point of elongation, the upper limit of an Mn amount is set at 0.30%. An excessive reduction of an Mn amount leads to the increase of a refining cost and therefore the lower limit of an Mn amount is set at 0.01%. In consideration of a production cost and corrosion resistance, a desirable upper limit of an Mn amount is 0.25%, and a more desirable range thereof is from 0.01 to 0.15%.

P, like Mn and Si, is a solid solution strengthening element and, therefore, the smaller the amount, the better. From the view point of elongation, the upper limit of a P amount is set at 0.04%. An excessive reduction of a P amount leads to the increase of a refining cost and therefore the lower limit of a P amount is set at 0.01%. In consideration of a production cost and corrosion resistance, a desirable upper limit of a P amount is 0.035%, and a more desirable range thereof is from 0.015 to 0.025%.

S, in the case of a Ti added steel, forms $Ti_4C_2S_2$ together with Ti and C and has the function of fixing C. $Ti_4C_2S_2$ is a coarse precipitate that precipitates at a high temperature. Therefore, the influence thereof on recrystallization and grain growth behavior is not significant but, if the precipitates are abundant, they act as the origin of rust and thus corrosion resistance deteriorates. Therefore, the upper limit of an S amount is set at 0.0100%. An excessive reduction of an S amount leads to the increase of a refining cost and, therefore, the lower limit of an S amount is set at 0.0010%. In consideration of a production cost and corrosion resistance, a desirable range of an S amount is from 0.0020 to 0.0060%.

Cr must be added to 10% or more for enhancing corrosion resistance and high temperature oxidization resistance. On the other hand, an addition of Cr in excess of 20% deteriorates not only toughness and thus the production operability but also elongation. Therefore, a Cr amount is limited in the range from 10 to 20%. Further, from the viewpoint of securing corrosion resistance and workability for the use in a general environment of chloride, atmospheric corrosion or acid such as sulfuric acid, a desirable Cr range is 16 to 19% and, more desirably, 16 to 17%.

N, like C, deteriorates workability and corrosion resistance and, therefore, the smaller the amount, the better. For that reason, the upper limit of an N amount is set at 0.020%. When an N amount is excessively reduced, TiN functioning as the nuclei of ferrite grain formation does not precipitate at the time of solidification even in the case of a steel containing Si of 0.2% or more wherein TiN can be used for fractionizing a solidification structure, thus columnar crystals develop, and it is feared that ridging resistance at the forming of a product sheet is deteriorated. For those reasons, the lower limit of an N amount is set at 0.001%. On the other hand, an excessive addition of N deteriorates elongation because of solute N. In consideration of a production cost and corrosion resistance, a desirable range of an N amount is from 0.004 to 0.015%, and a more desirable upper limit thereof is 0.01%.

Ti improves corrosion resistance, intergranular corrosion resistance and deep drawability by combining with C, N and S. Deep drawability is secured on account of the development of a recrystallization texture. By adding Ti, TiC, $Ti_4C_2S_2$ and TiN precipitate and grain boundaries are highly purified and resultantly the diffraction strength of {111}planes develops strongly during recrystallization annealing. By so doing, an r-value, that is an index of deep drawability, improves conspicuously. However, as Ti is a solid solution strengthening element, an excessive addition thereof leads to the increase of solute Ti and then the deterioration of elongation that is an index of punch stretchability. Therefore, the Ti amount is limited to the range from 0.05 to 0.30%. In consideration of a refining cost and the intergranular corrosion resistance of a weld, a desirable range of a Ti amount is 0.10 to 0.20%. Further, it is preferable to add Ti by 10(C+N) % or more for fixing C and N and securing corrosion resistance, in particular intergranular corrosion resistance at a heat affected zone.

The amounts of above Si, Mn, P and Ti, as a whole, must be regulated so that the value of Σ defined by the expression <1> may be 0.70 or less, $$\Sigma=0.9[Si]+8.6[P]+2[Ti]+0.5[Mn]-0.5 \quad <1>.$$

Mg is added for forming oxides containing Mg at the stage of molten steel, thus accelerating solidification and suppressing the development of coarse columnar crystals in a casting. Further, Mg forms Mg oxides together with Al in molten steel and functions not only as a deoxidizing agent but also as crystallization nuclei of TiN. TiN becomes solidification nuclei of a ferrite phase during the course of solidification. As a result, a ferrite phase can be refined at the time of solidification by acceleration of the crystallization of TiN. The fractionization of a solidification structure makes it possible to prevent the surface defects, such as ridging and roping, caused by a coarse solidification structure from forming on a steel product.

Mg is likely to evaporate when it is added to molten steel and also floats even when it forms oxides after the addition, and therefore the yield of Mg is low in some cases. Even though an Mg content is reduced up to 0.0002% in molten steel, as far as Mg is added so that the average composition of Mg containing oxides dispersing in a steel may satisfy the expressions <2> and <3>, the Mg containing oxides 1 μm or more in size exist in a casting at a sufficiently high density in terms of the number of the oxides and, therefore, the effect of the present invention can be elicited. For those reasons, the lower limit of an amount of Mg finally remaining in a casting is set at 0.0002%.

Further, as far as such an amount of Mg is contained, in the case of molten steel containing a certain amount of Si, it is also possible to actively form Mg oxides functioning as crystallization nuclei of TiN in the molten steel. However, if an Mg amount exceeds 0.0050%, weldability deteriorates and coarse MgS is formed and acts as the origin of rust. Therefore, the upper limit of a Mg amount is set at 0.0050%. For accelerating equiaxed crystallization in addition to the fractionization of columnar crystals in the event of fractionizing a solidification structure, it is desirable that a Mg amount is not less than 0.0010%.

The above components are the basic components in the present invention and the following components may be contained as occasion demands.

B is an element that improves secondary workability and the addition thereof to a Ti added steel is particularly effective. In a Ti added steel, though the strength of gain boundaries deteriorates and thus intergranular cracking tends to occur during secondary working since C is fixed by Ti, these are prevented by adding B by 0.0003% or more. However, an excessive addition of B deteriorates elongation. Therefore, a B amount is limited in the range from 0.0003 to 0.0050%. Further, in consideration of corrosion resistance and a refining cost, a desirable range thereof is from 0.0005 to 0.0020%.

Al is added by 0.005% or more as a deoxidizing agent. However, an excessive addition of Al deteriorates workability and surface quality. Therefore, an Al amount is limited in the range from 0.005 to 0.10%. Further, in consideration of a refining cost, a desirable range thereof is from 0.010 to 0.07%.

Mo, Ni and Cu are elements that improve corrosion resistance and one or more of them are added in an application requiring corrosion resistance. The effect is elicited by the addition amount of 0.1% or more. However, an excessive addition thereof deteriorates workability and particularly ductility and, therefore, the upper limit thereof is set at 2.0%. Further, in consideration of production operability and strength, a desirable range thereof is from 0.5 to 1.5%.

Nb, V and Zr are elements that improve workability and corrosion resistance and one or more of them are added in accordance with a required application. When Nb, V and Zr are added by 0.01% or more, 0.1% or more and 0.01% or more, respectively, the effects are elicited. However, an excessive addition thereof brings about the drawbacks of surface defects, uneven glossiness and the deterioration of ductility. For those reasons, the amounts of Nb, V and Zr are limited in the ranges from 0.01 to 0.5%, from 0.1 to 3.0% and from 0.01 to 0.5%, respectively. Further, in consideration of production operability and ductility, preferable ranges of Nb, V and Zr are from 0.1 to 0.3%, from 0.2 to 1.0% and from 0.05 to 0.3%, respectively.

A ferritic stainless steel sheet produced from an aforementioned casting according to the present invention is excellent in deep drawability, punch stretchability and ridging resistance.

In the present invention, the production methods were also studied in addition to the aforementioned chemical compositions.

The first method for producing a ferritic stainless steel sheet according to the present invention is a method for producing a ferritic stainless steel sheet characterized by using an aforementioned casting according to the present invention.

Figure 3:
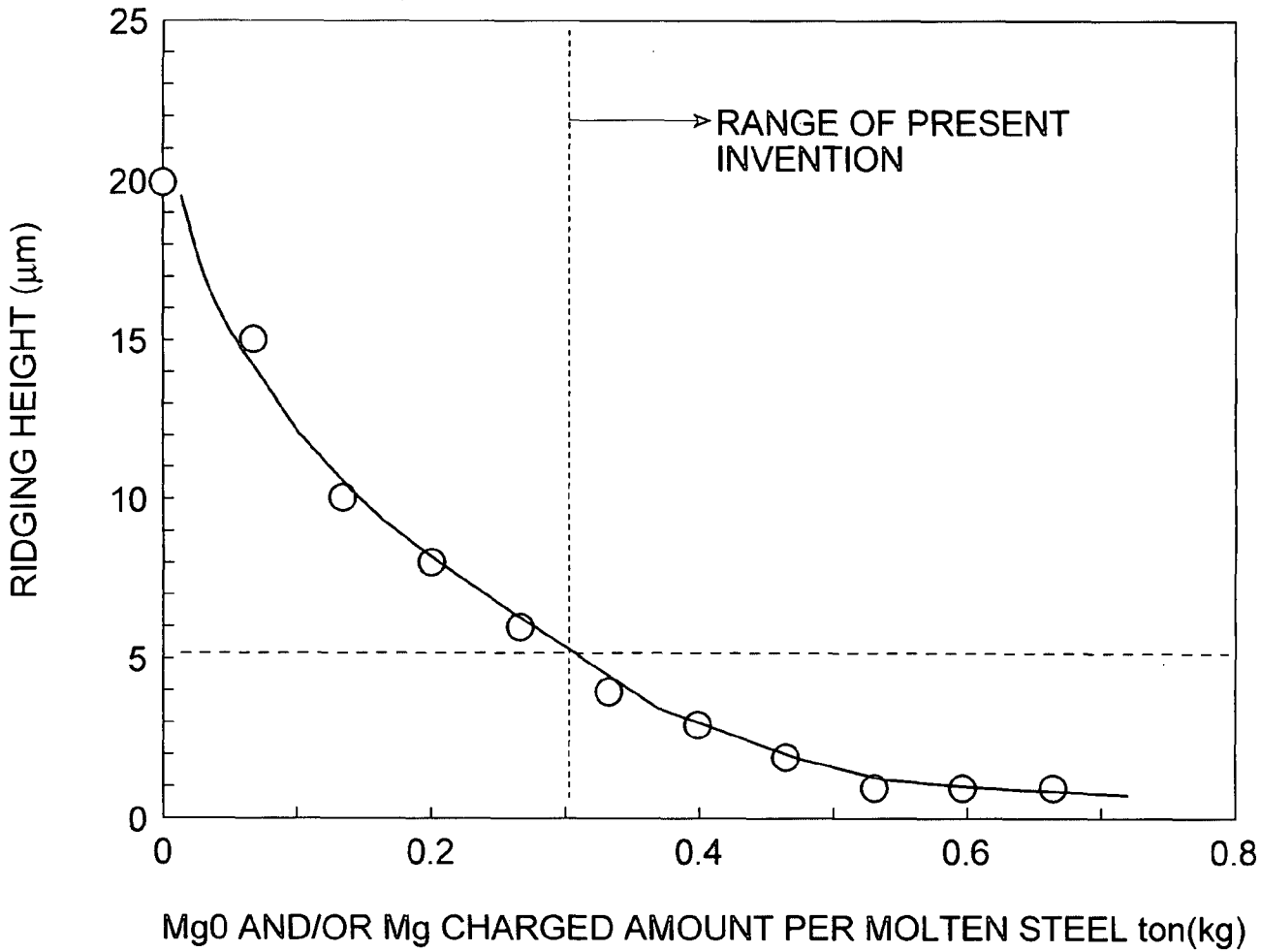
FIG. 3 is a graph showing the relationship between the Mg amounts charged in molten steel and the ridging of steel sheet products.

The second method for producing a ferritic stainless steel sheet according to the present invention relates to a method of adding Mg at the stage of melting and refining stainless steel. As stated earlier, the present inventors found that the addition of Mg affected a solidification structure that related significantly to ridging. FIG. 3 shows the relationship between the addition amounts in terms of Mg equivalent and the heights of the ridging of steel sheet products when MgO and/or metallic Mg are added to 150 tons of molten steel.

The data in FIG. 3 were obtained by adding MgO and/or metallic Mg by the amounts shown along the horizontal axis in FIG. 3 to a steel containing 16% Cr, 0,003% C, 0.1% Si, 0.1% Mn, 0.01% P, 0.002% S, 0.01% N, 0.0005% B, and 0.01% Al, thereafter subjecting the Mg added steels to the processes of hot rolling (4.0 mm in sheet thickness), cold rolling (400 mm in roll diameter and 2.0 mm in sheet thickness), intermediate annealing (880° C.), cold rolling (0.5 mm in sheet thickness) and annealing (900° C.), and then evaluating the ridging heights. Here, a ridging height was evaluated by taking a JIS No. 5 tensile test piece from a steel sheet product, imparting 16% strain to the test piece in the rolling direction, and thereafter measuring the heights of the jogs on the surface. When a ridging height is not more than 5 μm by this measurement method, the ridging height is regarded as a height at which ridging will not be visually observed even after severe press working.

From FIG. 3, it is understood that, by charging Mg in molten steel by not less than 0.30 kg per molten steel ton, a solidification structure is fractionized and ridging resistance is improved. Though Mg has a strong affinity with oxygen and forms MgO, it has been found that Mg tends to gasify in relation to other elements and therefore hardly remains in molten steel. However, by charging Mg in molten steel by not less than 0.30 kg per molten steel ton, a solidification structure is fractionized and ridging resistance is improved independently of the fluctuation of the Mg yield. Here, Mg added here can elicit a sufficient effect as long as it is added in the form of MgO and/or metallic Mg. In addition, a preferable amount of molten steel is 150 tons or more.

When a charged Mg amount is small, inclusions in molten steel become $CaO.Al_2O_3$ type inclusions having a low melting point and the function as solidification nuclei of ferrite is not secured. By securing a charged Mg amount of 0.30 kg/ton or more, inclusions become $MgO.Al_2O_3.CaO$ type inclusions and, even though CaO is mixed, the melting point rises and a composition satisfying the expressions <2> and <3> and being excellent in lattice matching with ferrite is obtained. When an Mg addition amount is further increased, inclusions are mainly composed of MgO and $MgO.Al_2O_3$ and the function of fractionizing a solidification structure is further intensified. Therefore, a charged Mg amount may arbitrarily be increased as long as the amount of Mg finally remaining in steel does not exceed the upper limit.

The third method for producing a ferritic stainless steel sheet according to the present invention relates to a method for rolling a steel sheet as explained below.

In general, a stainless steel sheet is produced by hot rolling a slab, subjecting a hot-rolled steel sheet to hot band annealing, and repeating cold rolling and recrystallization annealing once or more. In this case, the present inventors found that, by optimizing production conditions in accordance with components, deep drawability, punch stretchability and ridging resistance could be improved. The reasons for regulating the production method in the present invention are explained hereunder.

Figure 4:
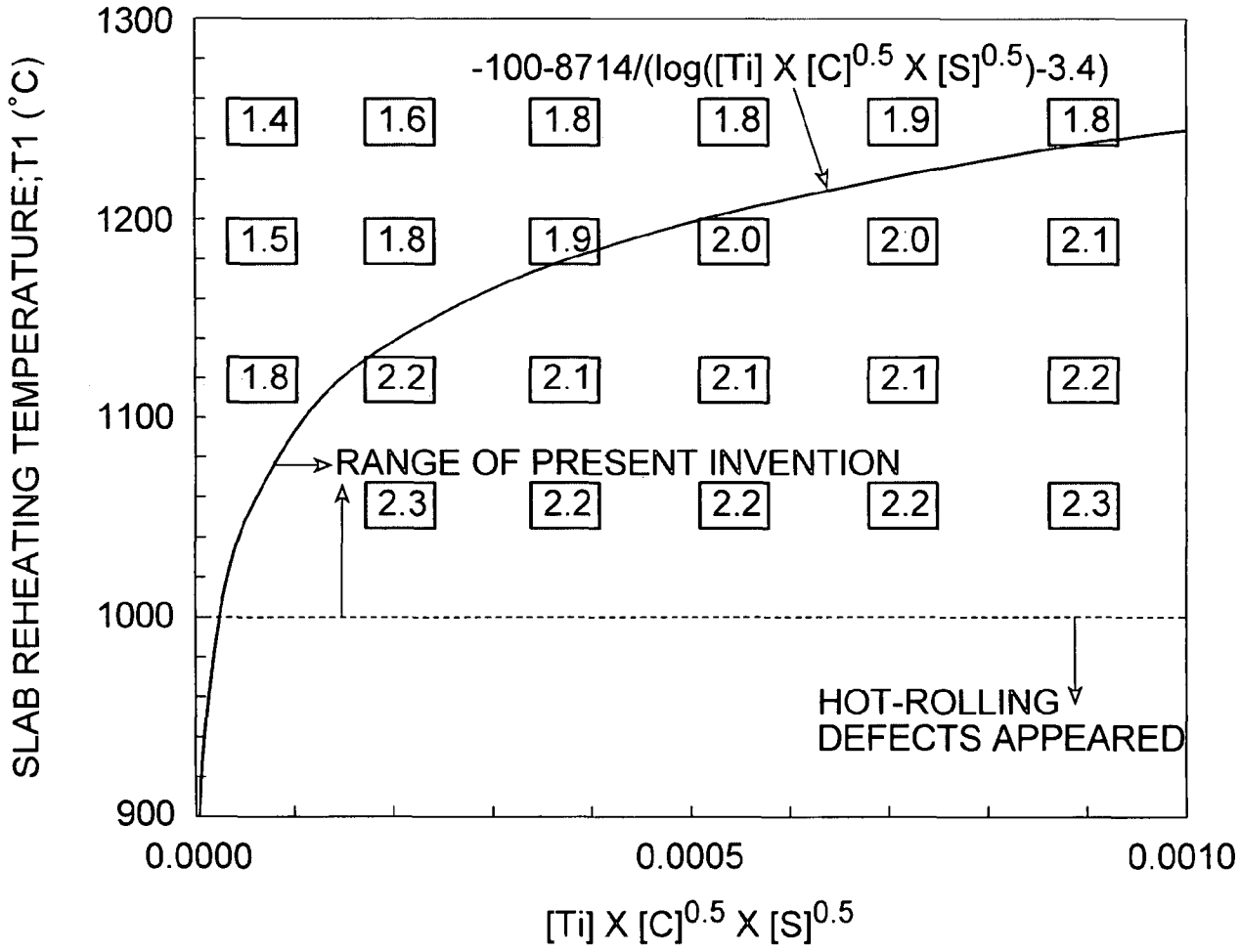
FIG. 4 is a graph showing the relationship between the slab reheating temperatures and the r-values of steel sheet products.

When a Ti added ferritic stainless steel sheet is hot rolled, $Ti_4C_2S_2$ may sometimes precipitate during the heating of a slab. If $Ti_4C_2S_2$ does not precipitate stably at the heating stage, it precipitates during hot rolling. By so doing, the recrystallization of a ferrite phase is delayed considerably. Such a solid solution/precipitation temperature varies in proportion to the amounts of [Ti], $[C]^{0.5}$ and $[S]^{0.5}$ and, in the present invention, it was found that, by heating a slab in a temperature range determined by components, $Ti_4C_2S_2$ precipitated stably and the r-value of a steel sheet product improved. FIG. 4 shows the relationship among the values of $[Ti]\times[C]^{0.5}\times[S]^{0.5}$, slab heating temperatures and r-values of steel sheet products. The data in FIG. 4 were obtained by subjecting a steel containing 16% Cr, 0.1% Si, 0.1% Mn, 0.01% P, 0.01% N, 0.0005% B, 0.01% Al, and 0.0002% Mg to the processes of hot rolling (4.0 mm in thickness), hot band annealing (930° C.), cold rolling (0.5 mm in sheet thickness) and annealing (900° C.). The contents of [Ti], [C] and [S] are in the ranges specified in the present invention. The numerals in the boxes are r-values. Here, an r-value was obtained by taking JIS No. 13B tensile test pieces from a steel sheet product, imparting 15% strains to the test pieces in the directions of rolling and of the angles of 45° and 90° with the rolling direction, and thereafter calculating the average r-value from the following expressions <9> and <10>, $$r=n(W_o/W)/\ln(t_o/t) \quad \text{<9>,}$$

where, $W_o$ meant an initial sheet width, W a sheet width after a strain was imparted, $t_o$ an initial sheet thickness, and t a sheet thickness after a strain was imparted, $$\text{average } r\text{-value}=(r_0+2r_{45}+r_{90})/4 \quad \text{<10>,}$$

where, $r_0$ meant an r-value in the rolling direction, $r_{45}$ an r-value at an angle of 45° with the rolling direction, and $r_{90}$ an r-value at an angle of 90° with the rolling direction. With regard to r-values, when an average r-value is 2.0 or more, the r-values are regarded as a level at which cracks do not occur even under severe deep drawing. From FIG. 4, it is understood that, by heating a slab in the temperature range shown by the aforementioned expression <4> stipulated in the present invention, a very high deep drawability can be obtained. This is because, in that temperature range, $Ti_4C_2S_4$ precipitates stably during the heating of a slab and recrystallization is accelerated during hot rolling. Here, it is preferable to set the lower limit of a slab heating temperature at 1,000° C. because, by so doing, defects can be prevented from occurring during rolling.

Though strain is accumulated by lowering a finishing temperature in hot rolling, when a coiling temperature is high, the strain is disengaged and a recovered structure is formed. In contrast, when a finishing temperature is high, strain is not accumulated. When strain is accumulated during hot rolling, recrystallization is accelerated during hot band annealing and ridging resistance is improved. When a finishing temperature and a coiling temperature are higher than 850° C. and 700° C., respectively, a recovered structure is formed, recrystallization hardly occurs during hot band annealing, and a band shaped recovered structure that causes ridging remains. Therefore, it is preferable that a finishing temperature and a coiling temperature are 850° C. or lower and 700° C. or lower, respectively.

Figure 5:
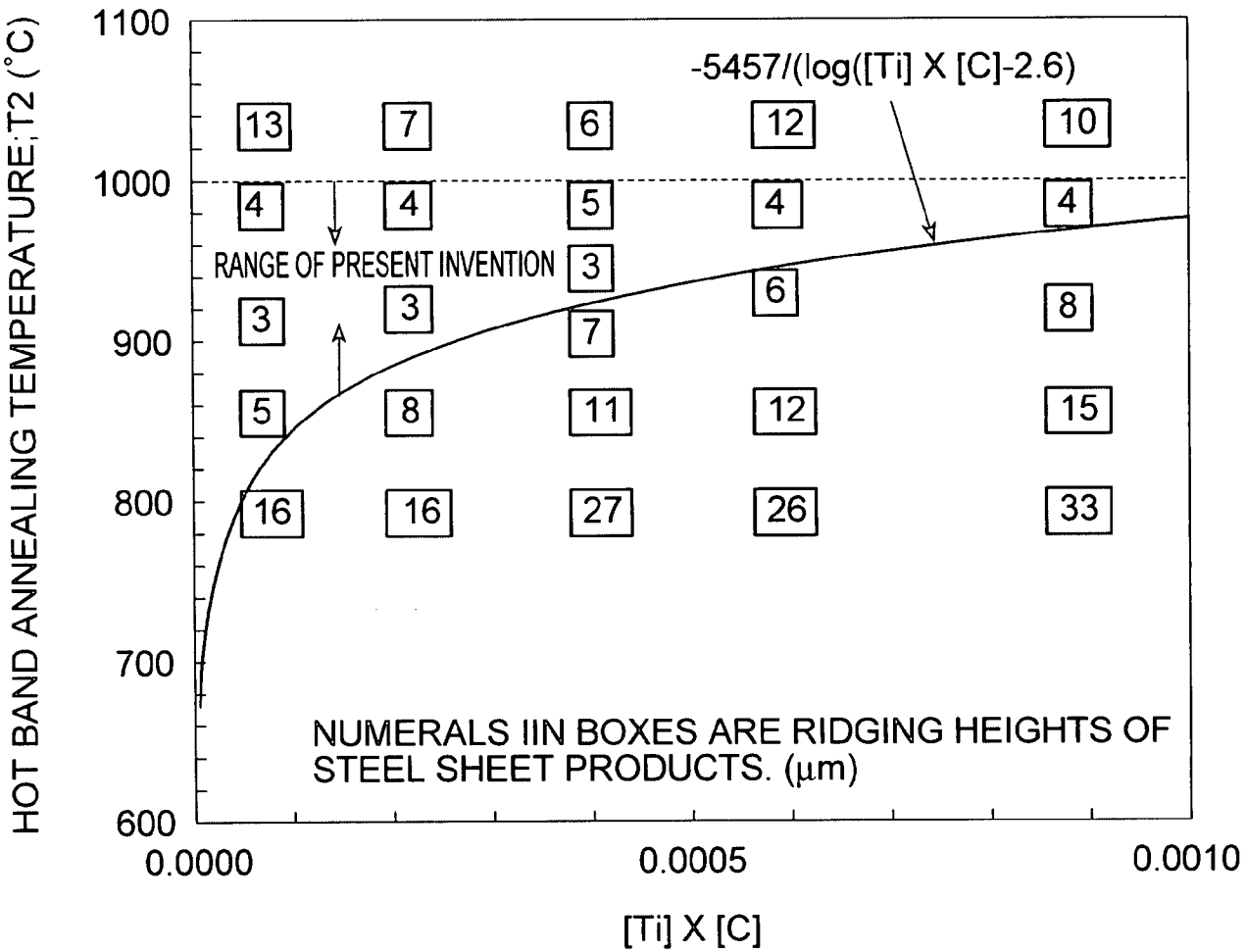
FIG. 5 is a graph showing the relationship between the hot band annealing temperatures and the ridging of steel sheet products.

Next, a hot band annealing temperature is explained. In general, hot band annealing is a process introduced for recrystallizing a processed structure formed during hot rolling and improving the workability and ridging resistance of a steel sheet product. However, even though hot band annealing is applied, ridging may sometimes occur conspicuously under severe working. In the present invention, it was found that, by optimizing a hot band annealing temperature in accordance with components, a steel sheet was improved to a level at which ridging scarcely occurred even under severe working. FIG. 5 shows the relationship among the contents of [Ti]×[C], hot band annealing temperatures and the ridging of steel sheet products. The data in FIG. 5 were obtained by subjecting a steel containing 16% Cr, 0.1% Si, 0.1% Mn, 0.01% P, 0.002% S, 0.01% N, 0.0005% B, 0.01% Al, and 0.0002% Mg to the processes of hot rolling (4.0 mm in thickness), hot band annealing (930° C.), cold rolling (0.5 mm in sheet thickness) and annealing (900° C.). The contents of [Ti] and [C] are in the ranges specified in the present invention. The numerals in the boxes are ridging heights (in μm). From FIG. 5, it is understood that, by applying annealing in the temperature range shown by the aforementioned expression <5> stipulated in the present invention, a ridging height can be lowered to 5 μm or less. TiC precipitating finely during hot rolling and hot band annealing is inclusions that delay the recrystallization of a ferrite phase and hinder grain sizing during annealing. When such inclusions exist stably, recrystallization is delayed, grains are not sized, and therefore a hot-rolling structure causing ridging is not completely fractionized. However, by heating a steel sheet in a temperature range in which TiC is dissolved, the recrystallization of a ferrite phase is accelerated, grains are sized, and therefore a rolling structure formed at hot rolling is fractionized completely and ridging resistance is improved conspicuously. Here, when a hot band annealing temperature is higher than 1,000° C., coarse grains are formed and ridging resistance deteriorates inversely. Therefore, the upper limit of a hot band annealing temperature is set at 1,000° C.

Figure 6:
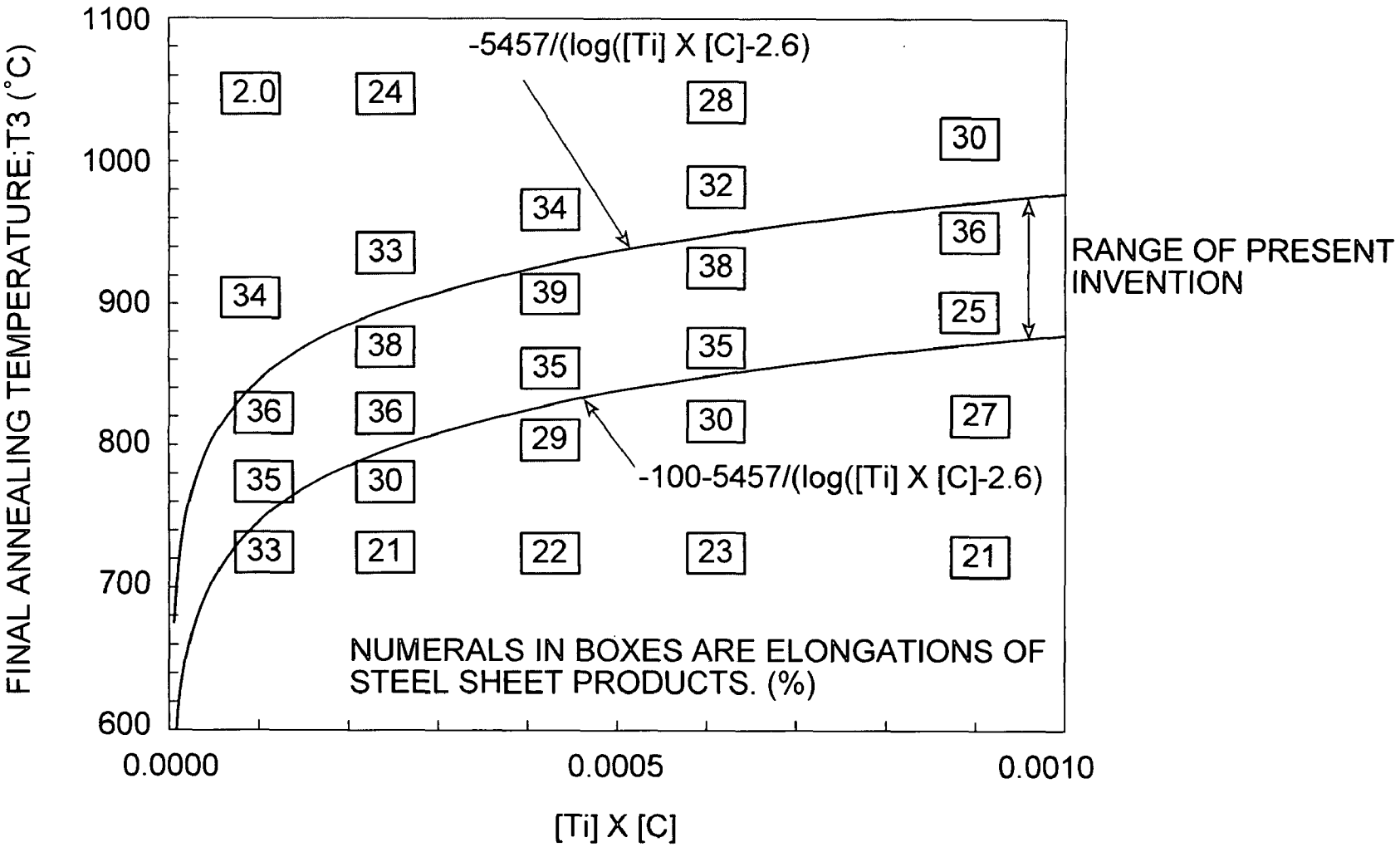
FIG. 6 is a graph showing the relationship between the final annealing temperatures and the elongations of steel sheet products.

Finally, a final annealing temperature is explained. In final annealing, it is effective particularly for improving elongation to apply annealing in the temperature range shown by the aforementioned expression <6>. Though it is effective for improving elongation to coarsen crystal grains to some extent, the optimum annealing temperature varies in accordance with components. This is because fine TiC influences the crystal grain growth at a final annealing temperature. In the present invention, annealing is applied in the temperature range from not higher than a TiC dissolving temperature to not lower than a TiC dissolving temperature −100° C. as shown in FIG. 6. The data in FIG. 6 were obtained by subjecting a steel containing 16% Cr, 0.1% Si, 0.1% Mn, 0.01% P, 0.002% S, 0.01% N, 0.0005% B, 0.01% Al, and 0.0002% Mg to the processes of hot rolling (4.0 mm in thickness), hot band annealing (930° C.), cold rolling (0.5 mm in sheet thickness) and annealing. The contents of [Ti] and [C] are in the ranges specified in the present invention. As an elongation, a breaking elongation obtained by taking a JIS No. 13B tensile test piece from a steel sheet product and pulling the test piece in the rolling direction was used. From FIG. 6, it is understood that, by applying heating in the temperature range shown by the expression <6>, an elongation of 35% or more can be obtained and that is a preferable level that allows severe punch stretching. When TiC dissolves, crystal grains coarsen excessively and the coarsened crystal grains are likely to fracture at grain boundaries. However, when a temperature is lower than a TiC dissolving temperature −100° C., a finely grained structure is formed and a high elongation is not obtained. Therefore, a very high elongation can be obtained by applying final annealing at an appropriate temperature at which TiC does not dissolve.

The fourth method for producing a ferritic stainless steel sheet according to the present invention relates to a method for rolling a steel sheet as explained below.

As stated above, in general, a stainless steel sheet is produced by hot rolling a slab, subjecting a hot-rolled steel sheet to hot band annealing, and repeating cold rolling and recrystallization annealing once or more. In this case, the present inventors found that, by optimizing production processes, deep drawability, punch stretchability and ridging resistance could be improved, and further, by eliminating a hot band annealing process that was generally employed, not only productivity improved but also workability improved further.

The feature of the findings is to eliminate hot band annealing after the hot rolling of a slab and to apply: cold rolling at a reduction ratio of 30% or more in a rolling mill equipped with rolls 300 mm or larger in diameter; thereafter intermediate annealing at a prescribed heating temperature; subsequently cold rolling to a prescribed sheet thickness; and then final annealing at a prescribed heating temperature.

In such a high-purity steel as a steel according to the present invention, when the steel is recrystallized in hot band annealing, a coarse grain structure is formed. This is because recovery proceeds at hot rolling and strain is not sufficiently accumulated. In contrast, when a certain degree of cold rolling is applied by using large diameter rolls without applying hot band annealing and intermediate annealing is further applied in between, a finely grained recrystallized structure is obtained. Thereafter, by further applying cold rolling and final annealing, workability can be improved. This is because cold-rolling strain is introduced to the processing at hot rolling and therefore crystal grains are fractionized at the intermediate annealing.

The reasons for regulating a production method according to the present invention are explained hereunder.

Figure 7:
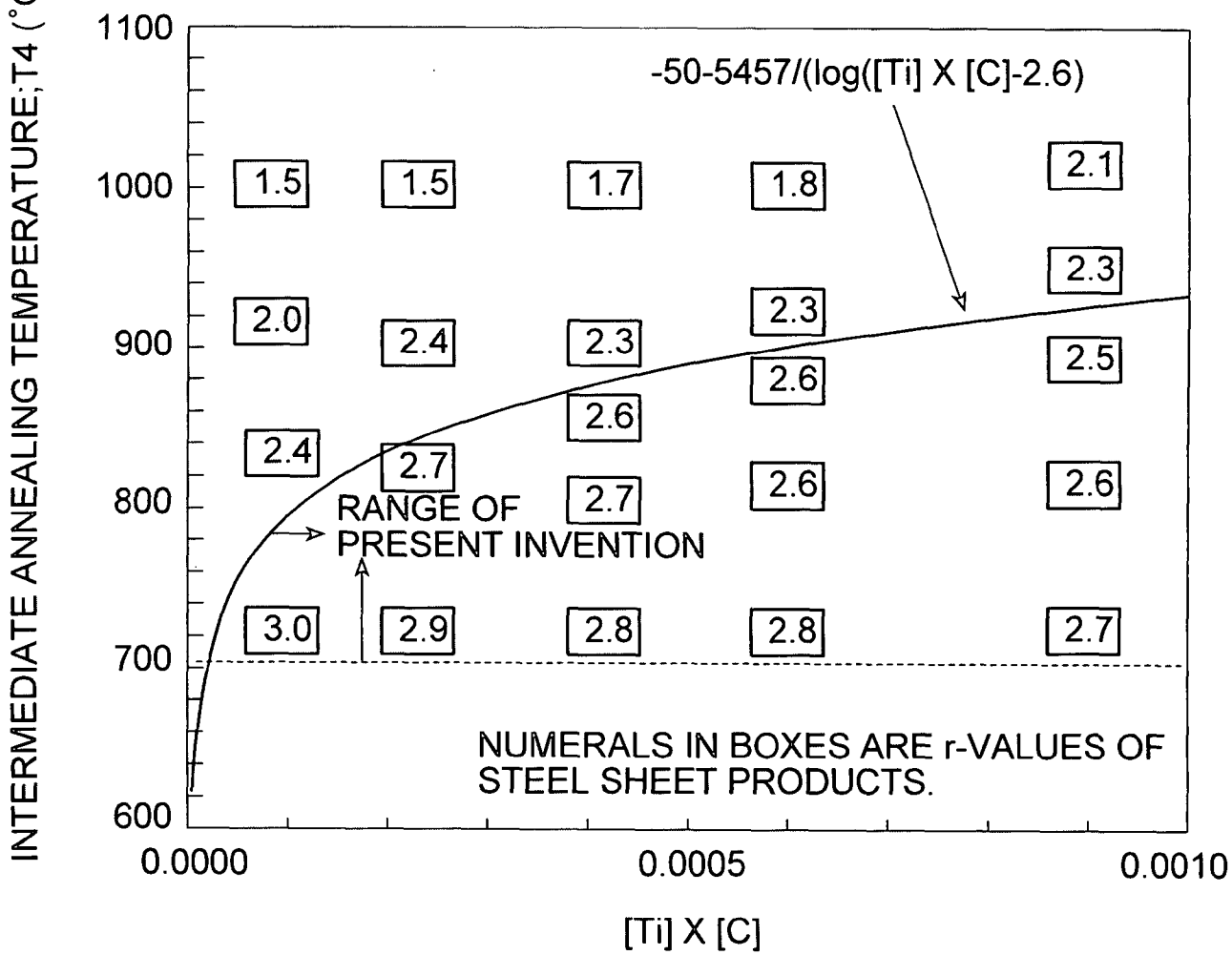
FIG. 7 is a graph showing the relationship between the intermediate annealing temperatures and the r-values of steel sheet products.

Generally speaking, when hot band annealing is eliminated, workability deteriorates. However, in the present invention, it was found that workability was improved by eliminating hot band annealing rather than applying it. The point of the finding is to suppress the introduction of shear strain and control a cold-rolling texture by rolling a steel sheet by using rolls 300 mm or larger in diameter in cold rolling after hot rolling. Though it has been disclosed as stated above that a larger roll diameter causes an r-value to improve, a new finding here is that hot band annealing is eliminated and an r-value is further improved by optimizing an intermediate annealing temperature in accordance with the amounts of Ti and C. FIG. 7 shows the relationship between r-values of steel sheet products and intermediate annealing temperatures. The data in FIG. 7 were obtained by subjecting a steel containing 16% Cr, 0.1% Si, 0.1% Mn, 0.01% P, 0.002% S, 0.01% N, 0.0005% B, 0.01% Al, and 0.0002% Mg to the processes of hot rolling (4.0 mm in sheet thickness), cold rolling (400 mm in roll diameter and 2.0 mm in sheet thickness), intermediate annealing, cold rolling (0.5 mm in sheet thickness) and annealing (900° C.). Here, an r-value was obtained by taking JIS No. 13B tensile test pieces from a steel sheet product, imparting 15% strains to the test pieces in the directions of rolling and of the angles of 45° and 90° with the rolling direction, and thereafter calculating the average r-value from the aforementioned expressions <9> and <10>.

With regard to r-values, when an average r-value is 2.5 or more, the r-values are regarded as a level that allows severe deep drawing. From FIG. 7, it is understood that, by applying intermediate annealing in the temperature range shown by the expression <7>, a very high deep drawability can be obtained even though hot band annealing is eliminated. This is because the stable precipitation of fine TiC that suppresses the excessive grain growth at the stage of intermediate annealing and the formation of fine recrystallized grains of ferrite contribute to the improvement of the r-values of a steel sheet product. When hot band annealing is once applied, coarse crystal grains are undesirably formed. On the contrary, in a steel to which hot band annealing is not applied, crystal grains are fractionized at the stage of intermediate annealing and therefore the r-values thereof are better. Further, even though cold rolling with large diameter rolls is applied, when a high temperature annealing, that causes crystal grains to coarsen, is applied during intermediate annealing, the effect of the large diameter rolls disappears. Here, since the workability of a steel sheet product deteriorates if recrystallization does not occur at annealing, the reduction ratio at cold rolling with large diameter rolls is set at 30% or more and the lower limit of an intermediate annealing temperature is set at 700° C.

Figure 8:
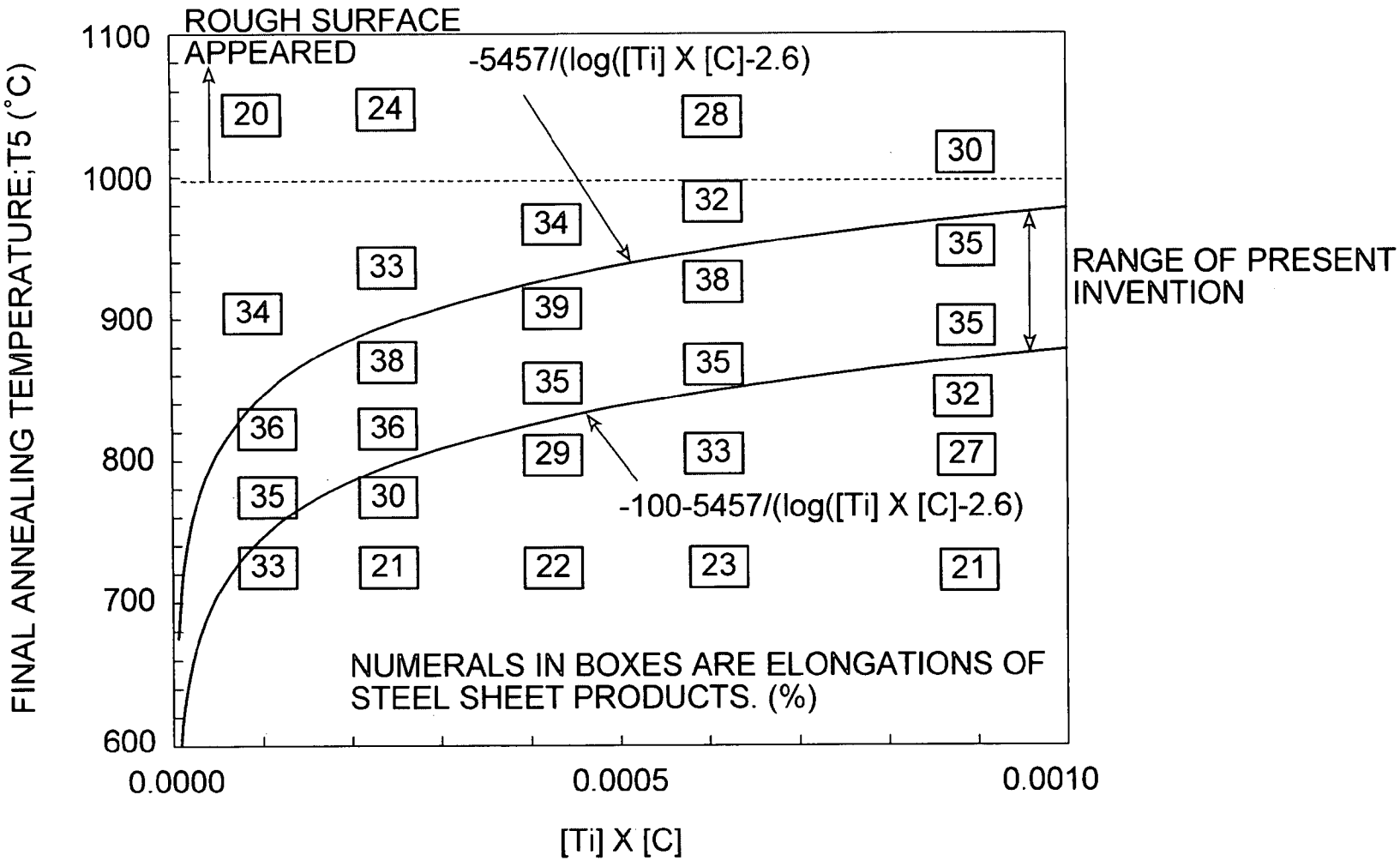
FIG. 8 is a graph showing the relationship between the final annealing temperatures and the elongations of steel sheet products.

Finally, a final annealing temperature is explained. In intermediate annealing, annealing is applied in a temperature range shown by the expression <7> for utilizing TiC and thus forming finely recrystallized grains. However, in final annealing, it is effective particularly for improving elongation to apply annealing in a temperature range shown by the expression <8>. In this method, annealing is applied in a high temperature range that does not exceed a TiC dissolving temperature and does not cause crystal grains to coarsen extremely. FIG. 8 shows the relationship between final annealing temperatures and elongations. The data in FIG. 8 were obtained by subjecting a steel containing 16% Cr, 0.1% Si, 0.1% Mn, 0.01% P, 0.002% S, 0.01% N, 0.0005% B, 0.01% Al, and 0.0002% Mg to the processes of hot rolling (4.0 mm in sheet thickness), cold rolling (400 mm in roll diameter and 2.0 mm in sheet thickness), intermediate annealing (880° C.), cold rolling (0.5 mm in sheet thickness) and final annealing. As an elongation, a breaking elongation obtained by taking a JIS No. 13B tensile test piece from a steel sheet product and pulling the test piece in the rolling direction was used. An elongation of 35% or more is a level that allows, in combination with an aforementioned r-value, to apply a steel sheet product to the forming to which a conventional ferritic stainless steel sheet cannot be applied. From FIG. 8, it is understood that, by applying heating in the temperature range determined by the expression <8>, elongation is improved. This is because, by applying annealing in a high temperature range that does not cause TiC to dissolve, the crystal grains in a ferrite phase are not extremely coarsened and grow to crystal grains advantageous to workability.

EXAMPLES

Example 1

Steels shown in Table 1 were melted and refined by the converter-vacuum refining method, further the components of the steels were finely tuned in a ladle refining process, and then metallic Mg or Mg oxide (MgO) was added by the injection method wherein a lance immersed in the molten steel was used. Then, castings 250 mm in thickness were produced through continuous casting.

In the melting and refining of the steels according to the present invention, soft deoxidization by Al was employed as the deoxidization of molten steel before Mg was added and the content of Al in the molten steel was controlled to 0.025% or less so that the added Mg might reduce $Al_2O_3$ and $MgO.Al_2O_3$ type inclusions might form easily. Further, by controlling the ratio between the concentrations of CaO and $Al_2O_3$ in slag and thus lowering the activity of CaO in the slag, the CaO activity of inclusions existing in equilibrium with slag in molten steel was lowered and thus the inclusions were prevented from having a low melting point. The injected amounts of Mg were adjusted as shown in Table 1 and the yields of Mg were secured.

The chemical components of each steel thus produced are shown in Table 1. A test piece for EPMA was cut out from a casting, the surface thereof was specularly polished with diamond, an inclusion about 1 μm or larger in size was detected with EPMA, and then the composition of the inclusion was analyzed by wavelength dispersive analysis (ZAF analysis). The inclusions are often observed in the form of oxide on which sulfide and nitride are precipitated in combination with the oxide during the course of cooling after solidification. The main elements composing oxide obtained by analysis are Mg, Al, Ca, Ti and Si. Further, Ti composes any of the oxide, the nitride and the sulfide. In view of the above fact, the compositions shown in Table 1 were obtained by using the analytical results of Mg, Al, Ca and Si, assuming that oxide consisted of the oxide of MgO, $Al_2O_3$, $MgAl_2O_4$ and CaO and the other oxide not containing Mg, Al and Ca (for example, $SiO_2$), and calculating mol % of the four kinds of oxides included in the expressions <2> and <3>.

TABLE 1

| | Components (mass %) | | | | | | | | | |
|---|---|---|---|---|---|---|---|---|---|---|
| | Cr | C | N | Si | Mn | P | S | Ti | Mg | Σ Note 1) |
| Invention sample 1 | 16.7 | 0.0025 | 0.0089 | 0.06 | 0.12 | 0.013 | 0.0015 | 0.15 | 0.0010 | 0.42 |
| Invention sample 2 | 16.5 | 0.0025 | 0.0080 | 0.08 | 0.08 | 0.011 | 0.0075 | 0.13 | 0.0002 | 0.35 |
| Invention sample 3 | 16.9 | 0.0017 | 0.0095 | 0.16 | 0.08 | 0.011 | 0.0020 | 0.18 | 0.0028 | 0.45 |
| Comparative sample 1 | 16.7 | 0.0017 | 0.0058 | 0.04 | 0.08 | 0.022 | 0.0020 | 0.12 | — | 0.42 |
| Comparative sample 2 | 16.7 | 0.0025 | 0.0088 | 0.06 | 0.15 | 0.012 | 0.0018 | 0.15 | 0.0010 | 0.43 |
| Comparative sample 3 | 16.9 | 0.0025 | 0.0091 | 0.55 | 0.35 | 0.027 | 0.0018 | 0.18 | 0.0003 | 0.72 |

| | Mg injected amount | Inclusion (mass %) | | | | Value of expression <2>; | Value of expression <3>; |
|---|---|---|---|---|---|---|---|
| | (kg/t) | ($Al_2O_3$) | (MgO) | ($MgAl_2O_4$) | (CaO) | Note 2) | Note 3) |
| Invention sample 1 | 0.3 | 7.5 | 25.3 | 52.3 | 11.8 | 465.5 | 96.9 |
| Invention sample 2 | 0.6 | 5.2 | 38.1 | 50.4 | 3.7 | 323.4 | 97.4 |
| Invention sample 3 | 0.6 | 7.3 | 23.6 | 50.8 | 13.7 | 490.5 | 95.4 |
| Comparative sample 1 | 0 | 55.8 | 7.5 | 15.7 | 12.1 | 1231.2 | 91.1 |
| Comparative sample 2 | 0.6 | 16.5 | 30.5 | 35.7 | 12.8 | 656.1 | 95.5 |
| Comparative sample 3 | 0.6 | 6.3 | 37.8 | 49.8 | 4.7 | 359.9 | 98.6 |

Note 1)

$\Sigma = 0.9Si + 8.6P + 2Ti + 0.5Mn - 0.5$ . . . <1>

Note 2)

$17.4(Al_2O_3) + 3.9(MgO) + 0.3(MgAl_2O_4) + 18.7(CaO) \leqq 500$ . . . <2>

Note 3)

$(Al_2O_3) + (MgO) + (MgAl_2O_4) + (CaO) \geqq 95$ . . . <3>

A macroscopic photograph of a transverse section of a casting (a plane perpendicular to the casting direction) was taken and the equiaxed crystal ratio (the ratio of area occupied by equiaxed crystals) was judged. Further, the average width of columnar crystals was determined by the value obtained by dividing the length of a segment (500 mm in length) drawn in the direction of the width at the depth of one fourth of the thickness on the macroscopic photograph by the number of columnar crystals intersected by the segment. The results are shown in Table 2.

The castings were hot rolled continuously at a hot strip mill, the hot-rolled steel sheets were subjected to hot band annealing and pickling and thereafter cold rolling, annealing and pickling, and, by so doing, steel sheets 0.5 mm in thickness were produced. JIS No. 13B and No. 5 tensile test pieces were cut out from the steel sheets in the rolling direction and each of them was subjected to a tensile test (yield strength YS and elongation El), and ridging measurement. With regard to r-value measurement, JIS No. 13B tensile test pieces were cut out from the steel sheets in the directions of rolling and of the angles of 45° and 90° with the rolling direction. An r-value was measured after a 15% tension was applied to a test piece. In the evaluation of ridging, a ridging height was obtained by measuring the surface of a steel sheet after a 16% tension was applied to the steel sheet with a roughness gage. The roping on the surface of a steel sheet was evaluated by a sensory test in terms four step evaluation A, B, C and D (roping deteriorates in the order from A to D). The results of evaluating the material quality of the steel sheets are shown in Table 2.

TABLE 2

| | Casting structure | | Steel sheet quality | | | | |
|---|---|---|---|---|---|---|---|
| | Columnar crystal width at one-fourth of thickness (mm) | Equiaxed crystal ratio (%) | YS (MPa) | El (%) | Average r-value | Ridging (μm) | Roping grade; Note 4) |
| Invention sample 1 | 3.0 | 17 | 260 | 37.8 | 2.1 | 8 | A |
| Invention sample 2 | 2.8 | 9 | 249 | 38.5 | 2.2 | 8 | A |
| Invention sample 3 | 2.4 | 36 | 250 | 36.0 | 2.1 | 7 | A |
| Comparative sample 1 | 10.0 | 7 | 255 | 37.9 | 2.2 | 22 | B-C |
| Comparative sample 2 | 11.2 | 9 | 262 | 36.8 | 2.1 | 25 | B-C |
| Comparative sample 3 | 2.5 | 55 | 278 | 34.0 | 1.7 | 8 | A |

Note 4)
Grading by sensory test; A: very good, B: good, C: fair, D: poor

Even in a high-purity steel wherein, in addition to the amounts of C and N, the amounts of Si, Mn, P and Ti, which are substitutional solid solution elements, are reduced, according to the present invention, as the development of coarse columnar crystals is suppressed and the width of the columnar crystals is reduced, a steel sheet not only having a high workability (a high elongation and a high r-value) caused by high purification but also being excellent in ridging resistance and roping resistance can be obtained. On the other hand, in the cases of the comparative examples 1 and 2 wherein Mg containing oxides related to the present invention are not formed, though workability is good, the ridging resistance and roping resistance are far inferior. In particular, in the case of the comparative example 2, coarse columnar crystals are formed in spite of Mg being contained by 10 ppm, and the fact shows that not only the addition of Mg but also the optimization of the composition of Mg oxide is important. In this case, the slag composition before Mg addition is inappropriate and therefore the value of $(CaO)/(Al_2O_3)$ is not less than 0.9. In the case of the comparative example 3 wherein high-purification is insufficient, workability itself is poor.

Example 2

Ferritic stainless steels having the compositions shown in Tables 3 and 5 were melted and refined, and then hot rolled into hot-rolled steel sheets 3.8 mm in thickness. Thereafter, the hot-rolled steel sheets were subjected to hot band continuous annealing, pickling and then cold rolled into cold-rolled steel sheets 0.5 mm in thickness. Subsequently, the cold-rolled steel sheets were subjected to the processes of continuous annealing, pickling and skin-pass rolling, and resultantly the steel sheet products were produced. In the tables, the charged amounts of metallic Mg and MgO mean the charged amounts (kg/ton) in terms of metallic Mg equivalent.

In the melting and refining of the steels according to the present invention, oxide compositions satisfying the expressions <2> and <3> were secured by adjusting the sequence of deoxidization, the control of slag compositions and the charged amounts of Mg, similarly to Example 1.

Test pieces were taken from thus produced steel sheet products 0.5 mm in thickness and r-values, elongations and ridging heights were measured. The methods of the measurements were the same as described earlier.

In Tables 4 and 6, TA, TB and TC are defined respectively by the equations below: $TA=-100-8{,}714/(\log([Ti]\times[C]^{0.5}\times[S]^{0.5})-3.4)$; $TB=-5{,}457/(\log([Ti]\times[C])-2.6)$; and $TC=-100-5{,}457/(\log([Ti]\times[C])-2.6)$.

As it is clear from Tables 3 to 6, the steels containing the chemical components stipulated in the present invention and having the Mg contents or the Mg addition amounts in the range stipulated in the present invention have high r-values, high elongations and low ridging heights, and are excellent in deep drawability, punch stretchability and ridging resistance.

Nos. 1 to 25 in Tables 3 and 4 are the invention examples. In each case of Nos. 1 to 7, though neither metallic Mg nor MgO is injected in molten steel, MgO is added in slag wherein the value of $(CaO)/(Al_2O_3)$ and Ti/Al are adjusted and dispersed Mg containing oxides satisfying the expressions <2> and <3> are formed in the molten steel by Mg supplied from the slag, and therefore a good ridging height is secured. In each case of Nos. 8 to 25, MgO and/or metallic Mg are charged by not less than 0.3 kg/molten steel ton in terms of metallic Mg equivalent and the amount of Mg in the steel is not less than 0.0002%, and therefore a good ridging height is secured.

Nos. 26 to 55 in Tables 5 and 6 are the comparative examples. In each case of Nos. 26, 39 and 40, both an Mg content and an Mg charged amount are insufficient, in each case of Nos. 27, 28 and 41 to 49, the production conditions are outside the ranges stipulated in the present invention, in each case of Nos. 29 and 37, the components and the production conditions are outside the ranges stipulated in the present invention, and, in each case of Nos. 30 to 36, 38 and 50 to 55, the components are outside the ranges stipulated in the present invention, and therefore sufficient quality is not secured.

Here, a slab thickness, a hot-rolled steel sheet thickness and the like may be designed properly. Further, in cold rolling too, a reduction ratio, roll roughness, rolling oil, a rolling pass number, a rolling speed and the like may be designed properly. Furthermore, by employing the double cold rolling method wherein intermediate annealing is interposed in between, the properties are improved further. In intermediate annealing and final annealing, either the process of annealing in a non-oxidation atmosphere such as hydrogen gas or nitrogen gas, or the process of annealing in the air and then pickling may be adopted.

TABLE 3

| | | Chemical compositions; mass % | | | | | | | | | | | | | | | | | | Metallic Mg, MgO | |
|---|---|---|---|---|---|---|---|---|---|---|---|---|---|---|---|---|---|---|---|---|---|
| | No | C | Si | Mn | P | S | Cr | N | B | Ti | Al | Mg | Mo | Ni | Cu | Nb | V | Zr | Σ | Charged amount; kg/t | Type |
| Invention sample | 1 | 0.002 | 0.1 | 0.1 | 0.01 | 0.001 | 16.1 | 0.006 | 0.0008 | 0.12 | 0.008 | 0.0002 | — | — | — | — | — | — | −0.034 | — | — |
| | 2 | 0.003 | 0.2 | 0.1 | 0.01 | 0.005 | 17.5 | 0.009 | 0.0008 | 0.15 | 0.008 | 0.0002 | 1.1 | — | — | — | — | — | 0.116 | — | — |
| | 3 | 0.005 | 0.3 | 0.1 | 0.03 | 0.001 | 16.5 | 0.015 | 0.0015 | 0.17 | 0.05 | 0.0003 | — | 1.2 | — | — | — | — | 0.418 | — | — |
| | 4 | 0.007 | 0.1 | 0.3 | 0.01 | 0.002 | 16.1 | 0.006 | 0.0025 | 0.11 | 0.02 | 0.0005 | — | — | 1.5 | — | — | — | 0.046 | — | — |
| | 5 | 0.008 | 0.1 | 0.1 | 0.02 | 0.006 | 18.5 | 0.012 | 0.0022 | 0.11 | 0.07 | 0.0002 | — | — | — | 0.4 | — | — | 0.032 | — | — |
| | 6 | 0.003 | 0.3 | 0.3 | 0.03 | 0.001 | 16.1 | 0.011 | 0.0008 | 0.08 | 0.009 | 0.0003 | — | — | — | — | 1.5 | — | 0.338 | — | — |
| | 7 | 0.005 | 0.1 | 0.2 | 0.01 | 0.001 | 16.7 | 0.017 | 0.0006 | 0.12 | 0.005 | 0.0002 | — | — | — | — | — | 0.5 | | — | — |
| | 8 | 0.003 | 0.1 | 0.1 | 0.01 | 0.002 | 16.2 | 0.007 | 0.0005 | 0.15 | 0.01 | 0.0002 | — | — | — | — | — | — | 0.026 | 0.33 | Metallic Mg |
| | 9 | 0.002 | 0.2 | 0.1 | 0.02 | 0.006 | 16.5 | 0.005 | 0.0003 | 0.12 | 0.02 | 0.0015 | — | — | — | — | — | — | 0.142 | 0.50 | MgO |
| | 10 | 0.004 | 0.1 | 0.2 | 0.01 | 0.001 | 16.3 | 0.003 | 0.0008 | 0.09 | 0.005 | 0.0008 | — | — | — | — | — | — | −0.044 | 0.40 | Metallic Mg |
| | 11 | 0.003 | 0.3 | 0.1 | 0.01 | 0.002 | 18.3 | 0.007 | 0.0005 | 0.20 | 0.05 | 0.0002 | — | — | — | — | — | — | | 0.33 | Metallic Mg + MgO |
| | 12 | 0.001 | 0.1 | 0.3 | 0.01 | 0.001 | 16.0 | 0.002 | 0.0003 | 0.10 | 0.007 | 0.0003 | — | — | — | — | — | — | 0.026 | 0.37 | Metallic Mg |
| | 13 | 0.001 | 0.1 | 0.1 | 0.01 | 0.001 | 11.3 | 0.002 | 0.0003 | 0.10 | 0.007 | 0.0003 | | | | | | | −0.074 | 0.37 | MgO |
| | 14 | 0.006 | 0.2 | 0.1 | 0.02 | 0.006 | 11.5 | 0.011 | 0.0003 | 0.14 | 0.02 | 0.0015 | — | — | — | — | — | — | 0.182 | 0.50 | Metallic Mg |
| | 15 | 0.003 | 0.2 | 0.1 | 0.02 | 0.008 | 14.5 | 0.005 | 0.0010 | 0.12 | 0.02 | 0.0020 | — | — | — | — | — | — | 0.142 | 0.67 | MgO |
| | 16 | 0.004 | 0.1 | 0.1 | 0.01 | 0.003 | 19.2 | 0.009 | 0.0007 | 0.11 | 0.006 | 0.0003 | 1.8 | — | — | — | — | — | −0.054 | 0.53 | Metallic Mg + MgO |
| | 17 | 0.005 | 0.1 | 0.1 | 0.01 | 0.003 | 17.5 | 0.016 | 0.0004 | 0.15 | 0.07 | 0.0002 | — | 1.5 | — | — | — | — | 0.026 | 0.73 | MgO |
| | 18 | 0.006 | 0.2 | 0.1 | 0.02 | 0.001 | 16.5 | 0.012 | 0.0006 | 0.13 | 0.03 | 0.0002 | — | — | 0.9 | — | — | — | 0.162 | 0.37 | MgO |
| | 19 | 0.006 | 0.2 | 0.2 | 0.02 | 0.001 | 18.5 | 0.008 | 0.0025 | 0.08 | 0.06 | 0.0002 | 2.0 | 0.5 | — | — | — | — | 0.112 | 0.40 | Metallic Mg + MgO |
| | 20 | 0.001 | 0.1 | 0.1 | 0.01 | 0.001 | 16.0 | 0.002 | 0.0003 | 0.10 | 0.007 | 0.0003 | 1.3 | — | 0.5 | — | — | — | −0.074 | 0.53 | MgO |
| | 21 | 0.005 | 0.1 | 0.2 | 0.01 | 0.004 | 19.2 | 0.013 | 0.0004 | 0.13 | 0.01 | 0.0005 | — | — | — | 0.22 | — | — | 0.036 | 0.47 | Metallic Mg + MgO |
| | 22 | 0.003 | 0.1 | 0.1 | 0.01 | 0.002 | 18.3 | 0.007 | 0.0005 | 0.20 | 0.05 | 0.0002 | — | — | — | — | 1.2 | — | 0.126 | 0.60 | MgO |
| | 23 | 0.005 | 0.1 | 0.1 | 0.01 | 0.002 | 15.1 | 0.013 | 0.0015 | 0.15 | 0.02 | 0.0003 | — | — | — | — | — | 0.1 | 0.026 | 0.67 | Metallic Mg |
| | 24 | 0.004 | 0.1 | 0.2 | 0.01 | 0.001 | 16.3 | 0.003 | 0.0008 | 0.09 | 0.005 | 0.0008 | — | — | — | 0.2 | 2.0 | — | −0.044 | 0.87 | Metallic Mg + MgO |
| | 25 | 0.003 | 0.2 | 0.1 | 0.02 | 0.001 | 11.5 | 0.006 | 0.0008 | 0.12 | 0.01 | 0.0002 | — | — | — | — | — | — | 0.142 | 0.33 | MgO |

TABLE 4

| | No | Hot rolling: TA ° C. | Hot rolling: Heating temperature; T1 ° C. | Hot rolling: Finishing temperature; ° C. | Hot rolling: Coiling temperature; ° C. | Hot band annealing: TB ° C. | Hot band annealing: Temperature; T2 ° C. | Final annealing: TC ° C. | Final annealing: Temperature; T3 ° C. | Elongation; % | r-value | Ridging height; μm |
|---|---|---|---|---|---|---|---|---|---|---|---|---|
| Invention sample | 1 | 1115 | 1100 | 800 | 620 | 877 | 925 | 777 | 870 | 39 | 2.4 | 4 |
| | 2 | 1213 | 1200 | 830 | 600 | 918 | 925 | 818 | 850 | 36 | 2.3 | 3 |
| | 3 | 1178 | 1150 | 820 | 670 | 962 | 980 | 862 | 900 | 37 | 2.1 | 4 |
| | 4 | 1184 | 1170 | 750 | 630 | 955 | 970 | 855 | 880 | 36 | 2.5 | 3 |
| | 5 | 1237 | 1200 | 710 | 610 | 965 | 970 | 865 | 880 | 35 | 2.6 | 5 |
| | 6 | 1101 | 1090 | 800 | 580 | 877 | 900 | 777 | 800 | 35 | 2.7 | 5 |
| | 7 | 1150 | 1100 | 800 | 620 | 937 | 925 | 837 | 870 | 37 | 2.4 | 4 |
| | 8 | 1175 | 1150 | 850 | 650 | 918 | 925 | 818 | 900 | 36 | 2.3 | 3 |
| | 9 | 1185 | 1170 | 800 | 680 | 877 | 945 | 777 | 920 | 35 | 2.4 | 2 |
| | 10 | 1120 | 1110 | 790 | 630 | 903 | 920 | 803 | 890 | 37 | 2.4 | 3 |
| | 11 | 1199 | 1150 | 750 | 550 | 937 | 910 | 837 | 900 | 37 | 2.2 | 1 |
| | 12 | 1078 | 1050 | 700 | 540 | 827 | 850 | 727 | 800 | 36 | 2.5 | 1 |
| | 13 | 1078 | 1050 | 830 | 550 | 827 | 850 | 727 | 800 | 40 | 2.1 | 1 |
| | 14 | 1246 | 1200 | 850 | 590 | 961 | 970 | 861 | 930 | 41 | 2.2 | 2 |
| | 15 | 1214 | 1200 | 800 | 640 | 903 | 920 | 803 | 890 | 42 | 2.1 | 3 |
| | 16 | 1178 | 1150 | 700 | 690 | 916 | 925 | 816 | 900 | 38 | 2.1 | 2 |
| | 17 | 1213 | 1150 | 730 | 650 | 953 | 960 | 853 | 940 | 39 | 2.3 | 1 |
| | 18 | 1163 | 1140 | 770 | 600 | 956 | 970 | 856 | 900 | 40 | 2.5 | 3 |
| | 19 | 1126 | 1100 | 800 | 680 | 922 | 940 | 822 | 910 | 36 | 2.8 | 4 |
| | 20 | 1078 | 1050 | 830 | 680 | 827 | 850 | 727 | 820 | 40 | 2.4 | 5 |
| | 21 | 1213 | 1150 | 840 | 670 | 943 | 960 | 843 | 930 | 36 | 2.1 | 3 |
| | 22 | 1199 | 1150 | 800 | 600 | 937 | 950 | 837 | 930 | 36 | 2.2 | 2 |
| | 23 | 1196 | 1150 | 790 | 630 | 953 | 970 | 853 | 900 | 42 | 2.6 | 3 |
| | 24 | 1120 | 1110 | 750 | 630 | 903 | 925 | 803 | 880 | 40 | 2.5 | 4 |
| | 25 | 1130 | 1100 | 850 | 630 | 903 | 920 | 803 | 880 | 36 | 2.1 | 4 |

TABLE 5

| | No | Chemical compositions; mass %: C | Si | Mn | P | S | Cr | N | B | Ti | Al | Mg | Mo | Ni | Cu | Nb | V | Zr | Σ | Metallic Mg, MgO: Charged amount; kg/t | Type |
|---|---|---|---|---|---|---|---|---|---|---|---|---|---|---|---|---|---|---|---|---|---|
| Comparative sample | 26 | 0.002 | 0.1 | 0.1 | 0.01 | 0.001 | 16.1 | 0.006 | 0.0008 | 0.12 | 0.008 | 0.0001 | — | — | — | — | — | — | −0.034 | — | — |
| | 27 | 0.002 | 0.1 | 0.1 | 0.01 | 0.001 | 16.1 | 0.006 | 0.0008 | 0.12 | 0.008 | 0.0002 | — | — | — | — | — | — | −0.034 | — | — |
| | 28 | 0.002 | 0.1 | 0.1 | 0.01 | 0.001 | 16.1 | 0.006 | 0.0008 | 0.12 | 0.008 | 0.0002 | — | — | — | — | — | — | −0.034 | — | — |
| | 29 | 0.012 | 0.1 | 0.1 | 0.01 | 0.002 | 16.2 | 0.007 | 0.0005 | 0.15 | 0.01 | 0.0002 | — | — | — | — | — | — | 0.026 | 0.33 | Metallic Mg |
| | 30 | 0.003 | 0.4 | 0.1 | 0.01 | 0.001 | 16.5 | 0.001 | 0.0005 | 0.15 | 0.01 | 0.0002 | — | — | — | — | — | — | 0.296 | 0.33 | Metallic Mg + MgO |
| | 31 | 0.005 | 0.3 | 0.4 | 0.02 | 0.005 | 18.3 | 0.003 | 0.0003 | 0.12 | 0.02 | 0.0015 | — | — | — | — | — | — | 0.382 | 0.50 | Metallic Mg |
| | 32 | 0.007 | 0.2 | 0.2 | 0.05 | 0.006 | 16.2 | 0.011 | 0.0008 | 0.09 | 0.005 | 0.0008 | — | — | — | — | — | — | 0.390 | 0.40 | MgO |
| | 33 | 0.003 | 0.3 | 0.2 | 0.03 | 0.02 | 16.5 | 0.012 | 0.0005 | 0.20 | 0.05 | 0.0002 | — | — | — | — | — | — | 0.528 | 0.33 | MgO |
| | 34 | 0.007 | 0.1 | 0.1 | 0.01 | 0.002 | 22 | 0.011 | 0.0003 | 0.14 | 0.02 | 0.0015 | — | — | — | — | — | — | 0.006 | 0.50 | Metallic Mg + MgO |
| | 35 | 0.003 | 0.2 | 0.2 | 0.02 | 0.001 | 16.8 | 0.025 | 0.0010 | 0.12 | 0.02 | 0.0020 | — | — | — | — | — | — | 0.192 | 0.67 | Metallic Mg |
| | 36 | 0.007 | 0.3 | 0.1 | 0.03 | 0.007 | 18.3 | 0.012 | 0.006 | 0.15 | 0.01 | 0.0002 | — | — | — | — | — | — | 0.378 | 0.33 | MgO |
| | 37 | 0.005 | 0.1 | 0.2 | 0.03 | 0.006 | 16.2 | 0.008 | 0.0005 | 0.35 | 0.02 | 0.0020 | — | — | — | — | — | — | 0.648 | 0.67 | Metallic Mg |
| | 38 | 0.007 | 0.2 | 0.3 | 0.01 | 0.002 | 16.5 | 0.012 | 0.0003 | 0.15 | 0.15 | 0.0002 | — | — | — | — | — | — | 0.216 | 0.33 | Metallic Mg |
| | 39 | 0.007 | 0.1 | 0.2 | 0.03 | 0.004 | 18.3 | 0.007 | 0.0005 | 0.09 | 0.02 | 0.0001 | — | — | — | — | — | — | 0.128 | 0.20 | MgO |
| | 40 | 0.007 | 0.1 | 0.2 | 0.03 | 0.004 | 18.3 | 0.007 | 0.0005 | 0.09 | 0.02 | 0.0001 | — | — | — | — | — | — | 0.128 | 0 | — |
| | 41 | 0.005 | 0.2 | 0.3 | 0.03 | 0.002 | 16.2 | 0.001 | 0.0003 | 0.20 | 0.006 | 0.0002 | — | — | — | — | — | — | 0.488 | 0.40 | Metallic Mg + MgO |

TABLE 5-continued

| | Chemical compositions; mass % | | | | | | | | | | | | | | | | | | Metallic Mg, MgO | |
|---|---|---|---|---|---|---|---|---|---|---|---|---|---|---|---|---|---|---|---|---|
| No | C | Si | Mn | P | S | Cr | N | B | Ti | Al | Mg | Mo | Ni | Cu | Nb | V | Zr | Σ | Charged amount; kg/t | Type |
| 42 | 0.003 | 0.1 | 0.1 | 0.01 | 0.001 | 11.3 | 0.003 | 0.0010 | 0.14 | 0.05 | 0.0002 | — | — | — | — | — | — | 0.006 | 0.33 | Metallic Mg + MgO |
| 43 | 0.005 | 0.1 | 0.2 | 0.02 | 0.005 | 14.5 | 0.012 | 0.0005 | 0.12 | 0.04 | 0.0015 | — | — | — | — | — | — | 0.102 | 0.53 | MgO |
| 44 | 0.005 | 0.2 | 0.3 | 0.01 | 0.002 | 16.2 | 0.007 | 0.0010 | 0.15 | 0.03 | 0.0002 | — | — | — | — | — | — | 0.216 | 0.27 | Metallic Mg |
| 45 | 0.005 | 0.2 | 0.3 | 0.01 | 0.002 | 16.2 | 0.007 | 0.0010 | 0.15 | 0.02 | 0.0002 | — | — | — | — | — | — | 0.216 | 0.27 | Metallic Mg |
| 46 | 0.007 | 0.1 | 0.1 | 0.02 | 0.001 | 16.5 | 0.012 | 0.0005 | 0.12 | 0.01 | 0.0015 | — | — | — | — | — | — | 0.052 | 0.47 | MgO |
| 47 | 0.007 | 0.1 | 0.1 | 0.02 | 0.001 | 16.5 | 0.012 | 0.0005 | 0.12 | 0.01 | 0.0015 | — | — | — | — | — | — | 0.052 | 0.47 | MgO |
| 48 | 0.004 | 0.1 | 0.2 | 0.01 | 0.001 | 16.3 | 0.005 | 0.0008 | 0.09 | 0.01 | 0.0008 | — | — | — | — | — | — | −0.044 | 0.40 | Metallic Mg + MgO |
| 49 | 0.004 | 0.1 | 0.2 | 0.01 | 0.001 | 16.3 | 0.003 | 0.0008 | 0.09 | 0.03 | 0.0008 | — | — | — | — | — | — | −0.044 | 0.40 | MgO |
| 50 | 0.005 | 0.2 | 0.2 | 0.04 | 0.002 | 16.5 | 0.013 | 0.0005 | 0.18 | 0.07 | 0.0008 | 2.5 | — | — | — | — | — | 0.484 | 0.33 | Metallic Mg |
| 51 | 0.003 | 0.2 | 0.2 | 0.03 | 0.005 | 16.6 | 0.002 | 0.0003 | 0.13 | 0.05 | 0.0002 | — | 3.0 | — | — | — | — | 0.298 | 0.30 | Metallic Mg + MgO |
| 52 | 0.002 | 0.1 | 0.2 | 0.01 | 0.006 | 16.8 | 0.008 | 0.0008 | 0.08 | 0.03 | 0.0003 | — | — | 3.0 | — | — | — | 0.064 | 0.37 | Metallic Mg |
| 53 | 0.003 | 0.3 | 0.3 | 0.02 | 0.005 | 16.2 | 0.009 | 0.0003 | 0.09 | 0.01 | 0.0006 | — | — | — | 0.8 | — | — | 0.272 | 0.60 | MgO |
| 54 | 0.005 | 0.1 | 0.1 | 0.02 | 0.002 | 16.1 | 0.007 | 0.0003 | 0.11 | 0.05 | 0.0013 | — | — | — | — | 4.0 | — | 0.032 | 0.57 | Metallic Mg + MgO |
| 55 | 0.005 | 0.1 | 0.2 | 0.01 | 0.001 | 18.8 | 0.015 | 0.0010 | 0.16 | 0.008 | 0.0002 | — | — | — | — | — | 0.8 | 0.096 | 0.63 | Metallic Mg |

TABLE 6

| | | Hot rolling | | | | Hot band annealing | | Final annealing | | | | |
|---|---|---|---|---|---|---|---|---|---|---|---|---|
| | No | TA ° C. | Heating temperature; T1 ° C. | Finishing temperature; ° C. | Coiling temperature; ° C. | TB ° C. | Temperature; T2 ° C. | TC ° C. | Temperature; T3 ° C. | Elongation; % | r-value | Ridging height; μm |
| Invention example | 26 | 1115 | 1100 | 800 | 620 | 877 | 925 | 777 | 870 | 39 | 2.4 | 10 |
| | 27 | 1115 | 1230 | 850 | 650 | 877 | 925 | 777 | 900 | 36 | 1.8 | 5 |
| | 28 | 1115 | 1170 | 800 | 680 | 877 | 850 | 777 | 920 | 35 | 2.4 | 15 |
| | 29 | 1234 | 1200 | 790 | 650 | 1021 | 1040 | 921 | 1000 | 32 | 2.4 | 3 |
| | 30 | 1147 | 1130 | 750 | 680 | 918 | 930 | 818 | 900 | 33 | 2.3 | 4 |
| | 31 | 1216 | 1150 | 700 | 630 | 937 | 950 | 837 | 900 | 31 | 2.4 | 4 |
| | 32 | 1214 | 1150 | 830 | 550 | 941 | 950 | 841 | 900 | 29 | 2.3 | 4 |
| | 33 | 1303 | 1200 | 850 | 540 | 937 | 950 | 837 | 900 | 34 | 2.3 | 3 |
| | 34 | 1204 | 1150 | 800 | 550 | 973 | 990 | 873 | 950 | 27 | 2.2 | 3 |
| | 35 | 1130 | 1100 | 790 | 590 | 903 | 925 | 803 | 870 | 30 | 2.3 | 2 |
| | 36 | 1266 | 1100 | 750 | 640 | 978 | 980 | 878 | 950 | 32 | 2.3 | 2 |
| | 37 | 1324 | 1200 | 700 | 650 | 1019 | 1000 | 919 | 1000 | 31 | 2.2 | 3 |
| | 38 | 1210 | 1150 | 830 | 680 | 978 | 990 | 878 | 940 | 33 | 2.1 | 3 |
| | 39 | 1196 | 1150 | 800 | 550 | 941 | 950 | 841 | 900 | 35 | 2.2 | 10 |
| | 40 | 1196 | 1150 | 800 | 550 | 941 | 950 | 841 | 900 | 35 | 2.2 | 28 |
| | 41 | 1221 | 1150 | 880 | 540 | 974 | 980 | 874 | 940 | 35 | 2.1 | 16 |
| | 42 | 1142 | 1100 | 830 | 750 | 913 | 920 | 813 | 900 | 35 | 2.0 | 12 |
| | 43 | 1216 | 1150 | 900 | 800 | 937 | 950 | 837 | 900 | 36 | 2.0 | 23 |
| | 44 | 1196 | 1250 | 830 | 640 | 953 | 970 | 853 | 930 | 34 | 1.9 | 2 |
| | 45 | 1196 | 1200 | 830 | 640 | 953 | 970 | 853 | 930 | 26 | 1.7 | 3 |
| | 46 | 1163 | 1150 | 780 | 550 | 961 | 970 | 861 | 850 | 31 | 2.4 | 3 |
| | 47 | 1163 | 1150 | 760 | 350 | 961 | 980 | 861 | 1000 | 33 | 2.1 | 2 |
| | 48 | 1120 | 1110 | 790 | 630 | 903 | 1020 | 803 | 890 | 37 | 2.4 | 23 |
| | 49 | 1120 | 1110 | 790 | 630 | 903 | 850 | 803 | 890 | 38 | 2.4 | 16 |
| | 50 | 1211 | 1200 | 830 | 630 | 967 | 980 | 867 | 870 | 29 | 1.8 | 3 |

TABLE 6-continued

| No | TA ° C. | Hot rolling: Heating temperature; T1 ° C. | Hot rolling: Finishing temperature; ° C. | Hot rolling: Coiling temperature; ° C. | Hot band annealing: TB ° C. | Hot band annealing: Temperature; T2 ° C. | Final annealing: TC ° C. | Final annealing: Temperature; T3 ° C. | Elongation; % | r-value | Ridging height; μm |
|---|---|---|---|---|---|---|---|---|---|---|---|
| 51 | 1201 | 1150 | 800 | 600 | 908 | 930 | 808 | 870 | 30 | 2.1 | 5 |
| 52 | 1152 | 1130 | 750 | 590 | 853 | 890 | 753 | 840 | 29 | 1.6 | 4 |
| 53 | 1171 | 1150 | 830 | 600 | 885 | 890 | 785 | 870 | 28 | 2.4 | 4 |
| 54 | 1171 | 1150 | 830 | 600 | 931 | 950 | 831 | 900 | 31 | 2.5 | 3 |
| 55 | 1173 | 1150 | 810 | 600 | 958 | 960 | 858 | 900 | 29 | 2.1 | 4 |

Example 3

Ferritic stainless steels having the compositions shown in Tables 7 and 9 were melted and refined and, then, were hot rolled into hot-rolled steel sheets 3.8 mm in thickness. Thereafter, the hot-rolled steel sheets were pickled without subjected to hot band annealing, then subjected to cold rolling, intermediate annealing and another cold-rolling for producing cold-rolled steel sheets 0.5 mm in thickness. Subsequently, the cold-rolled steel sheets were subjected to the processes of continuous annealing, pickling and skin-pass rolling, and resultantly the steel sheet products were produced. Here, some of the comparative steels were subjected to hot band annealing. In the tables, the charged amounts of metallic Mg and MgO mean the charged amounts (kg/ton) in terms of metallic Mg equivalent.

In the melting and refining of the steels according to the present invention, oxide compositions satisfying the expressions <2> and <3> were secured by adjusting the sequence of deoxidization, the control of slag compositions and the charged amounts of Mg, similarly to Example 1.

Test pieces were taken from thus produced steel sheet products 0.5 mm in thickness and r-values, elongations and ridging heights were measured. The methods of the measurements were the same as described earlier.

In Tables 8 and 10, TA, TB and TC are defined respectively by the equations below: $TA=-50-5{,}457/(\log([Ti]\times[C])-2.6)$; $TB=-5{,}457/(\log([Ti]\times[C])-2.6)$; and $TC=-100-5{,}457/(\log([Ti]\times[C])-2.6)$.

As it is clear from Tables 7 to 10, the steels containing the chemical components stipulated in the present invention, having the Mg contents or the Mg addition amounts in the range stipulated in the present invention, and satisfying the production conditions stipulated in the present invention have high r-values, high elongations and low ridging heights, and are excellent in deep drawability, punch stretchability and ridging resistance.

Nos. 1 to 21 in Tables 7 and 8 are the invention examples. In each case of Nos. 1, 2, 6 to 8 and 14 to 16, though neither metallic Mg nor MgO is injected in molten steel, MgO is added in slag wherein the value of $(CaO)/(Al_2O_3)$ and Ti/Al are adjusted and dispersed Mg containing oxides satisfying the expressions <2> and <3> are formed in the molten steel by Mg supplied from the slag, and therefore a good ridging height is secured. In each case of Nos. 3 to 5, 9 to 13 and 17 to 21, MgO and/or metallic Mg are charged by not less than 0.3 kg/molten steel ton in terms of metallic Mg equivalent and the amount of Mg in the steel is not less than 0.0002%, and therefore a good ridging height is secured.

Nos. 22 to 46 in Tables 9 and 10 are the comparative examples. In each case of Nos. 32 and 33, both an Mg content and an Mg charged amount are insufficient, in each case of Nos. 22 to 31 and 41 to 46, the components are outside the ranges stipulated in the present invention, and, in each case of Nos. 34 to 40, the production conditions are outside the ranges stipulated in the present invention, and therefore sufficient quality is not secured.

Here, a slab thickness, a hot-rolled steel sheet thickness and the like may be designed properly. Further, in cold rolling too, a reduction ratio, roll roughness, rolling oil, a rolling pass number, a rolling speed and the like may be designed properly. Furthermore, in intermediate annealing and final annealing, either a bright annealing process of annealing in a non-oxidation atmosphere such as hydrogen gas or nitrogen gas, or the process of annealing in the air and then pickling may be adopted.

TABLE 7

| | No | C | Si | Mn | P | S | Cr | N | B | Ti | Al | Mg | Mo | Ni | Cu | Nb | V | Zr | Σ | Metallic Mg, MgO: Charged amount; kg/t | Metallic Mg, MgO: Mg Type |
|---|---|---|---|---|---|---|---|---|---|---|---|---|---|---|---|---|---|---|---|---|---|
| | | Chemical compositions; mass % | | | | | | | | | | | | | | | | | | | |
| Invention sample | 1 | 0.003 | 0.1 | 0.1 | 0.01 | 0.002 | 16.2 | 0.007 | 0.0005 | 0.15 | 0.010 | 0.0002 | — | — | — | — | — | — | 0.026 | — | |
| | 2 | 0.005 | 0.2 | 0.1 | 0.02 | 0.006 | 16.5 | 0.005 | 0.0003 | 0.12 | 0.020 | 0.0015 | — | — | — | — | — | — | 0.142 | — | |
| | 3 | 0.004 | 0.1 | 0.2 | 0.01 | 0.001 | 16.3 | 0.003 | 0.0008 | 0.11 | 0.005 | 0.0002 | — | — | — | — | — | — | −0.004 | 0.40 | Metallic Mg |
| | 4 | 0.003 | 0.1 | 0.1 | 0.01 | 0.002 | 18.3 | 0.007 | 0.0005 | 0.20 | 0.050 | 0.0008 | — | — | — | — | — | — | 0.126 | 0.33 | Metallic Mg |
| | 5 | 0.001 | 0.1 | 0.1 | 0.01 | 0.001 | 16.0 | 0.002 | 0.0003 | 0.10 | 0.007 | 0.0003 | — | — | — | — | — | — | | 0.37 | MgO |
| | 6 | 0.001 | 0.1 | 0.1 | 0.01 | 0.001 | 11.3 | 0.002 | 0.0003 | 0.10 | 0.007 | 0.0003 | 1.5 | — | — | — | — | — | | — | |
| | 7 | 0.006 | 0.2 | 0.1 | 0.02 | 0.006 | 11.5 | 0.011 | 0.0003 | 0.14 | 0.020 | 0.0015 | — | 0.9 | — | — | — | — | 0.182 | — | |
| | 8 | 0.003 | 0.2 | 0.1 | 0.02 | 0.008 | 14.5 | 0.005 | 0.0010 | 0.12 | 0.020 | 0.0020 | — | — | 1.5 | — | — | — | 0.142 | — | |
| | 9 | 0.003 | 0.1 | 0.2 | 0.01 | 0.001 | 16.2 | 0.007 | 0.0005 | 0.15 | 0.007 | 0.0009 | 1.2 | — | — | — | — | — | 0.076 | 0.40 | MgO |
| | 10 | 0.005 | 0.2 | 0.2 | 0.01 | 0.001 | 16.5 | 0.002 | 0.0003 | 0.12 | 0.007 | 0.0001 | — | 1.2 | — | — | — | — | | 0.37 | MgO |

TABLE 7-continued

| No | Chemical compositions; mass % | | | | | | | | | | | | | | | | | Σ | Metallic Mg, MgO: Charged amount; kg/t | Metallic Mg, MgO: Mg Type |
|---|---|---|---|---|---|---|---|---|---|---|---|---|---|---|---|---|---|---|---|---|
| | C | Si | Mn | P | S | Cr | N | B | Ti | Al | Mg | Mo | Ni | Cu | Nb | V | Zr | | | |
| 11 | 0.003 | 0.1 | 0.2 | 0.02 | 0.006 | 16.3 | 0.002 | 0.0008 | 0.09 | 0.020 | 0.0002 | — | — | 1.1 | — | — | — | 0.042 | 0.33 | Metallic Mg |
| 12 | 0.005 | 0.2 | 0.1 | 0.02 | 0.008 | 16.2 | 0.007 | 0.0005 | 0.20 | 0.020 | 0.0002 | 1.5 | 0.5 | — | — | — | — | 0.302 | 0.87 | Metallic Mg + MgO |
| 13 | 0.003 | 0.1 | 0.1 | 0.02 | 0.001 | 16.5 | 0.002 | 0.0003 | 0.10 | 0.007 | 0.0002 | 1.6 | — | 0.6 | — | — | — | 0.012 | 0.50 | Metallic Mg |
| 14 | 0.005 | 0.2 | 0.2 | 0.02 | 0.001 | 16.3 | 0.002 | 0.0003 | 0.10 | 0.007 | 0.0003 | — | — | — | 0.2 | — | — | 0.152 | — | |
| 15 | 0.005 | 0.1 | 0.2 | 0.02 | 0.006 | 16.2 | 0.007 | 0.0003 | 0.14 | 0.020 | 0.0002 | — | — | — | — | 1.5 | — | 0.142 | — | |
| 16 | 0.003 | 0.1 | 0.1 | 0.01 | 0.008 | 16.5 | 0.015 | 0.0010 | 0.10 | 0.030 | 0.0002 | — | — | — | — | — | 0.1 | −0.074 | — | |
| 17 | 0.004 | 0.3 | 0.3 | 0.03 | 0.002 | 18.5 | 0.008 | 0.0008 | 0.12 | 0.050 | 0.0003 | — | — | — | 0.2 | 0.1 | — | 0.418 | 0.67 | Metallic Mg |
| 18 | 0.006 | 0.1 | 0.2 | 0.02 | 0.005 | 19.2 | 0.005 | 0.0015 | 0.17 | 0.010 | 0.0002 | — | — | — | — | 1.5 | — | 0.202 | 0.53 | MgO |
| 19 | 0.005 | 0.3 | 0.1 | 0.03 | 0.002 | 16.5 | 0.006 | 0.0090 | 0.15 | 0.040 | 0.0002 | — | — | — | — | — | 0.1 | | 0.60 | Metallic Mg |
| 20 | 0.003 | 0.2 | 0.3 | 0.01 | 0.001 | 15.3 | 0.010 | 0.0011 | 0.15 | 0.080 | 0.0003 | — | — | — | 0.2 | 0.1 | — | 0.216 | 0.67 | Metallic Mg + MgO |
| 21 | 0.003 | 0.2 | 0.1 | 0.02 | 0.001 | 11.5 | 0.006 | 0.0008 | 0.12 | 0.01 | 0.0002 | — | — | — | — | — | — | 0.142 | 0.33 | |

TABLE 8

| | No | Application of hot band annealing | Intermediate cold rolling: Roll diameter; mm | Intermediate cold rolling: Reduction ratio; % | Intermediate annealing: TA ° C. | Intermediate annealing: Temperature; T1 ° C. | Final annealing: TB ° C. | Final annealing: TC ° C. | Final annealing: Temperature; T2 ° C. | Elongation; % | r-value | Ridging height; μm |
|---|---|---|---|---|---|---|---|---|---|---|---|---|
| Invention sample | 1 | Not applied | 400 | 30 | 868 | 850 | 918 | 818 | 900 | 35 | 2.6 | 5 |
| | 2 | Not applied | 400 | 40 | 887 | 870 | 937 | 837 | 900 | 36 | 2.7 | 4 |
| | 3 | Not applied | 400 | 50 | 866 | 840 | 916 | 816 | 870 | 38 | 2.8 | 5 |
| | 4 | Not applied | 400 | 30 | 887 | 850 | 937 | 837 | 920 | 38 | 2.5 | 3 |
| | 5 | Not applied | 300 | 30 | 777 | 780 | 827 | 727 | 820 | 37 | 2.9 | 2 |
| | 6 | Not applied | 400 | 30 | 777 | 780 | 827 | 727 | 820 | 42 | 3.0 | 1 |
| | 7 | Not applied | 400 | 40 | 911 | 890 | 961 | 861 | 900 | 40 | 3.0 | 3 |
| | 8 | Not applied | 500 | 50 | 853 | 830 | 903 | 803 | 880 | 35 | 3.1 | 5 |
| | 9 | Not applied | 400 | 30 | 868 | 850 | 918 | 818 | 850 | 35 | 2.7 | 1 |
| | 10 | Not applied | 400 | 40 | 887 | 840 | 937 | 837 | 850 | 36 | 3.0 | 2 |
| | 11 | Not applied | 300 | 50 | 835 | 810 | 885 | 785 | 850 | 35 | 2.8 | 4 |
| | 12 | Not applied | 500 | 30 | 924 | 900 | 974 | 874 | 900 | 37 | 2.9 | 3 |
| | 13 | Not applied | 400 | 30 | 841 | 830 | 891 | 791 | 850 | 35 | 3.1 | 5 |
| | 14 | Not applied | 400 | 30 | 875 | 850 | 925 | 825 | 900 | 35 | 2.8 | 4 |
| | 15 | Not applied | 400 | 40 | 898 | 840 | 948 | 848 | 850 | 36 | 2.6 | 3 |
| | 16 | Not applied | 500 | 50 | 841 | 810 | 891 | 791 | 850 | 35 | 2.7 | 2 |
| | 17 | Not applied | 400 | 40 | 872 | 820 | 922 | 822 | 870 | 35 | 2.8 | 2 |
| | 18 | Not applied | 300 | 40 | 926 | 900 | 976 | 876 | 900 | 36 | 2.6 | 3 |
| | 19 | Not applied | 500 | 50 | 903 | 810 | 953 | 853 | 870 | 35 | 2.7 | 2 |
| | 20 | Not applied | 400 | 40 | 868 | 820 | 918 | 818 | 870 | 35 | 2.8 | 2 |
| | 21 | Not applied | 600 | 40 | 853 | 800 | 903 | 803 | 880 | 35 | 2.6 | 4 |

TABLE 9

| | No. | Chemical compositions; mass % | | | | | | | | | | | | | | | | | | Metallic Mg, MgO: Charged amount kg/t | Metallic Mg, MgO: Mg Type |
|---|---|---|---|---|---|---|---|---|---|---|---|---|---|---|---|---|---|---|---|---|---|
| | | C | Si | Mn | P | S | Cr | N | B | Ti | Al | Mg | Mo | Ni | Cu | Nb | V | Zr | Σ | | |
| Comparative sample | 22 | 0.012 | 0.1 | 0.1 | 0.01 | 0.002 | 16.2 | 0.007 | 0.0005 | 0.15 | 0.01 | 0.0002 | — | — | — | — | — | — | 0.026 | 0.33 | |
| | 23 | 0.003 | 0.4 | 0.1 | 0.01 | 0.001 | 16.5 | 0.001 | 0.0005 | 0.15 | 0.01 | 0.0002 | — | — | — | — | — | — | 0.296 | 0.33 | |
| | 24 | 0.005 | 0.3 | 0.4 | 0.02 | 0.005 | 18.3 | 0.003 | 0.0003 | 0.12 | 0.02 | 0.0015 | — | — | — | — | — | — | 0.382 | 0.50 | |
| | 25 | 0.007 | 0.2 | 0.2 | 0.05 | 0.006 | 16.2 | 0.011 | 0.0008 | 0.09 | 0.005 | 0.0008 | — | — | — | — | — | — | 0.390 | 0.40 | |
| | 26 | 0.003 | 0.3 | 0.2 | 0.03 | 0.02 | 16.5 | 0.012 | 0.0005 | 0.20 | 0.05 | 0.0002 | — | — | — | — | — | — | 0.528 | 0.33 | |

TABLE 9-continued

| | Chemical compositions; mass % | | | | | | | | | | | | | | | | | | Metallic Mg, MgO | |
|---|---|---|---|---|---|---|---|---|---|---|---|---|---|---|---|---|---|---|---|---|
| No. | C | Si | Mn | P | S | Cr | N | B | Ti | Al | Mg | Mo | Ni | Cu | Nb | V | Zr | Σ | Charged amount kg/t | Mg Type |
| 27 | 0.007 | 0.1 | 0.1 | 0.01 | 0.002 | 22 | 0.011 | 0.0003 | 0.14 | 0.02 | 0.0015 | — | — | — | — | — | — | 0.006 | 0.50 | |
| 28 | 0.003 | 0.2 | 0.2 | 0.02 | 0.001 | 16.8 | 0.025 | 0.0010 | 0.12 | 0.02 | 0.0020 | — | — | — | — | — | — | 0.192 | 0.67 | |
| 29 | 0.007 | 0.3 | 0.1 | 0.03 | 0.007 | 18.3 | 0.012 | 0.006 | 0.15 | 0.01 | 0.0002 | — | — | — | — | — | — | 0.378 | 0.33 | |
| 30 | 0.005 | 0.1 | 0.2 | 0.03 | 0.006 | 16.2 | 0.008 | 0.0005 | 0.35 | 0.02 | 0.0020 | — | — | — | — | — | — | 0.648 | 0.67 | |
| 31 | 0.007 | 0.2 | 0.3 | 0.01 | 0.002 | 16.5 | 0.012 | 0.0003 | 0.15 | 0.15 | 0.0002 | — | — | — | — | — | — | 0.216 | 0.33 | |
| 32 | 0.007 | 0.1 | 0.2 | 0.03 | 0.004 | 18.3 | 0.007 | 0.0005 | 0.09 | 0.02 | 0.0001 | — | — | — | — | — | — | 0.128 | 0.27 | |
| 33 | 0.007 | 0.1 | 0.2 | 0.03 | 0.004 | 18.3 | 0.007 | 0.0005 | 0.09 | 0.02 | 0.0001 | — | — | — | — | — | — | 0.218 | — | |
| 34 | 0.005 | 0.2 | 0.3 | 0.03 | 0.002 | 16.2 | 0.001 | 0.0003 | 0.20 | 0.005 | 0.0002 | — | — | — | — | — | — | 0.488 | 0.40 | |
| 35 | 0.003 | 0.1 | 0.1 | 0.01 | 0.001 | 11.3 | 0.003 | 0.0010 | 0.14 | 0.05 | 0.0002 | — | — | — | — | — | — | 0.006 | 0.33 | |
| 36 | 0.005 | 0.1 | 0.2 | 0.02 | 0.005 | 14.5 | 0.012 | 0.0005 | 0.12 | 0.02 | 0.0015 | — | — | — | — | — | — | 0.102 | 0.53 | |
| 37 | 0.005 | 0.2 | 0.3 | 0.01 | 0.002 | 16.2 | 0.007 | 0.0010 | 0.15 | 0.02 | 0.0002 | — | — | — | — | — | — | 0.216 | 0.27 | |
| 38 | 0.005 | 0.2 | 0.3 | 0.01 | 0.002 | 16.2 | 0.007 | 0.0010 | 0.15 | 0.02 | 0.0002 | — | — | — | — | — | — | 0.216 | 0.27 | |
| 39 | 0.007 | 0.1 | 0.1 | 0.02 | 0.001 | 16.5 | 0.012 | 0.0005 | 0.12 | 0.01 | 0.0015 | — | — | — | — | — | — | 0.052 | 0.47 | |
| 40 | 0.007 | 0.1 | 0.1 | 0.02 | 0.001 | 16.5 | 0.012 | 0.0005 | 0.12 | 0.01 | 0.0015 | — | — | — | — | — | — | 0.052 | 0.47 | |
| 41 | 0.003 | 0.1 | 0.2 | 0.01 | 0.001 | 16.2 | 0.007 | 0.0005 | 0.15 | 0.007 | 0.0009 | 2.5 | — | — | — | — | — | 0.076 | 0.4 | |
| 42 | 0.005 | 0.2 | 0.2 | 0.01 | 0.001 | 16.5 | 0.002 | 0.0003 | 0.12 | 0.007 | 0.0001 | — | 3.0 | — | — | — | — | 0.106 | 0.37 | |
| 43 | 0.003 | 0.1 | 0.2 | 0.02 | 0.006 | 16.3 | 0.002 | 0.0008 | 0.09 | 0.020 | 0.0002 | — | — | 3.0 | — | — | — | 0.042 | 0.33 | |
| 44 | 0.005 | 0.2 | 0.2 | 0.02 | 0.001 | 16.3 | 0.002 | 0.0003 | 0.10 | 0.007 | 0.0003 | — | — | — | 0.8 | — | — | 0.152 | 0.51 | |
| 45 | 0.005 | 0.1 | 0.2 | 0.02 | 0.006 | 16.2 | 0.007 | 0.0003 | 0.14 | 0.020 | 0.0002 | — | — | — | — | 4.0 | — | 0.142 | 0.53 | |
| 46 | 0.003 | 0.1 | 0.1 | 0.01 | 0.008 | 16.5 | 0.002 | 0.0010 | 0.12 | 0.020 | 0.0002 | — | — | — | — | — | 0.8 | −0.034 | 0.60 | |

TABLE 10

| | | | Intermediate cold rolling | | Intermediate annealing | | Final annealing | | | | | |
|---|---|---|---|---|---|---|---|---|---|---|---|---|
| | No | Application of hot band annealing | Roll diameter; mm | Reduction ratio; % | TA ° C. | Temperature; T1 ° C. | TB ° C. | TC ° C. | Temperature; T2 ° C. | Elongation; % | r-value | Ridging height; μm |
| Comparative sample | 22 | Not applied | 500 | 30 | 971 | 900 | 1021 | 921 | 1000 | 34 | 2.5 | 3 |
| | 23 | Not applied | 500 | 40 | 868 | 850 | 918 | 818 | 900 | 33 | 2.6 | 5 |
| | 24 | Not applied | 500 | 50 | 887 | 850 | 937 | 837 | 920 | 30 | 2.8 | 5 |
| | 25 | Not applied | 500 | 30 | 891 | 850 | 941 | 841 | 920 | 31 | 2.7 | 5 |
| | 26 | Not applied | 500 | 40 | 887 | 850 | 937 | 837 | 910 | 30 | 2.6 | 4 |
| | 27 | Not applied | 600 | 50 | 923 | 900 | 973 | 873 | 950 | 28 | 2.5 | 3 |
| | 28 | Not applied | 600 | 30 | 853 | 800 | 903 | 803 | 870 | 31 | 2.7 | 2 |
| | 29 | Not applied | 600 | 40 | 928 | 900 | 978 | 878 | 950 | 30 | 2.6 | 2 |
| | 30 | Not applied | 600 | 50 | 969 | 950 | 1019 | 919 | 1000 | 29 | 2.5 | 3 |
| | 31 | Not applied | 600 | 30 | 928 | 900 | 978 | 878 | 950 | 30 | 2.5 | 3 |
| | 32 | Not applied | 400 | 50 | 891 | 850 | 941 | 841 | 930 | 35 | 2.5 | 10 |
| | 33 | Not applied | 400 | 50 | 891 | 850 | 941 | 841 | 930 | 35 | 2.5 | 25 |
| | 34 | Applied | 300 | 30 | 924 | 900 | 974 | 874 | 940 | 35 | 2.3 | 4 |
| | 35 | Not applied | 200 | 40 | 863 | 850 | 913 | 813 | 900 | 35 | 2.1 | 5 |
| | 36 | Not applied | 300 | 20 | 887 | 850 | 937 | 837 | 890 | 36 | 2 | 5 |
| | 37 | Not applied | 300 | 30 | 903 | 650 | 953 | 853 | 920 | 33 | 1.9 | 4 |
| | 38 | Not applied | 300 | 30 | 903 | 920 | 953 | 853 | 920 | 36 | 2.2 | 3 |
| | 39 | Not applied | 300 | 40 | 911 | 900 | 961 | 861 | 850 | 31 | 2.4 | 3 |
| | 40 | Not applied | 300 | 40 | 911 | 900 | 961 | 861 | 1000 | 27 | 2.1 | 2 |
| | 41 | Not applied | 400 | 30 | 868 | 850 | 918 | 818 | 850 | 30 | 2.4 | 3 |
| | 42 | Not applied | 400 | 40 | 887 | 840 | 937 | 837 | 850 | 31 | 2.5 | 5 |
| | 43 | Not applied | 400 | 50 | 835 | 810 | 885 | 785 | 850 | 28 | 2.3 | 4 |
| | 44 | Not applied | 400 | 30 | 875 | 850 | 925 | 825 | 900 | 29 | 2.8 | 4 |
| | 45 | Not applied | 400 | 40 | 898 | 840 | 948 | 848 | 850 | 30 | 2.6 | 3 |
| | 46 | Not applied | 500 | 50 | 853 | 810 | 903 | 803 | 850 | 28 | 2.7 | 4 |

INDUSTRIAL APPLICABILITY

The present invention makes it possible to provide: a ferritic stainless steel casting used for producing a ferritic stainless steel sheet that is excellent in workability (elongation and Lankford value) and, at the same time, has minute ridging and roping; a steel sheet produced from said casting; and the production method of said casting and steel sheet. Therefore, the present invention is very important industrially.

The invention claimed is:

1. A method for producing a ferritic stainless steel sheet having an average r-value of 2.0 or more, an ridging height of 5 μm or less and an elongation of 35% or more, comprising using a casting wherein:

said casting contains, in mass, 0.001 to 0.010% C, 0.01 to 0.30% Si, 0.01 to 0.30% Mn, 0.01 to 0.04% P, 0.0010 to 0.0100% S, 10 to 20% Cr, 0.001 to 0.020% N, 0.05 to 0.30% Ti, 0.0002 to 0.0050% Mg, and further contains Al and/or Ca, with a balance consisting of Fe and unavoidable impurities, and the value of Σ defined by the expression <1> is 0.70 or less, $$\Sigma=0.9[Si]+8.6[P]+2[Ti]+0.5[Mn]-0.5 \quad <1>;$$

wherein [Si], [P], [Ti], and [Mn] represents contents of Si, P, Ti and Mn in said steel, respectively, and the average composition of the Mg containing oxides dispersing in said casting satisfies the expressions <2> and <3>, $$17.4(Al_2O_3)+3.9(MgO)+0.3(MgAl_2O_4)+18.7(CaO)\leqq 500 \quad <2>,$$

$$(Al_2O_3)+(MgO)+(MgAl_2O_4)+(CaO)\geqq 95 \quad <3>,$$

wherein the chemical components in the parentheses mean mol % of the relevant chemical components, respectively, said method comprising hot rolling the casting by a method comprising heating said casting to temperature T1 within the range defined by the expression <4>, subjecting said heated casting to rough rolling of plural passes, and finishing rolling of plural passes at a temperature of 850° C. or lower;

coiling said hot-rolled steel sheet at a temperature of 700° C. or lower;

annealing said hot-rolled steel sheet at a heating temperature T2 in the range defined by the expression <5>;

cold rolling said annealed steel sheet; and subsequently annealing said cold-rolled steel sheet at a heating temperature T3 in the range defined by the expression <6>, $$1{,}000\leqq T1(°\ C.)\leqq -100-8{,}714/(\log([Ti]\times[C]^{0.5}\times[S]^{0.5})-3.4) \quad <4>,$$

$$-5{,}457/(\log([T1]\times[C])-2.6)\leqq T2(°\ C.)\leqq 1{,}000 \quad <5>,$$

$$-100-5{,}457/(\log([Ti]\times[C])-2.6)\leqq T3(°\ C.)\leqq -5{,}457/(\log([Ti]\times[C])-2.6) \quad <6>$$

wherein [Ti], [C], and [S] represents contents of Ti, C, and S in said steel, respectively.

2. A method for producing a ferritic stainless steel sheet according to claim 1, characterized by charging MgO and/or metallic Mg in molten steel at not less than 0.30 kg per molten steel ton in terms of Mg equivalent.

3. A method for producing a ferritic stainless steel sheet according to claim 1, characterized in that said casting further contains, in mass, 0.0003 to 0.0050% B and/or 0.005 to 0.1% Al.

4. A method for producing a ferritic stainless steel sheet according to claim 1, characterized in that said casting further contains, in mass, one or more of 0.1 to 2.0% Mo, 0.1 to 2.0% Ni, and 0.1 to 2.0% Cu.

5. A method for producing a ferritic stainless steel sheet according to claim 1, characterized in that said casting further contains, in mass, one or more of 0.01 to 0.5% Nb, 0.1 to 3.0% V, and 0.01 to 0.5% Zr.

6. A method for producing a ferritic stainless steel sheet according to claim 1, characterized in that the average width of columnar crystals in said casting is 4 mm or less at a portion in the depth of one fourth of the thickness of said casting.

* * * * *